US011608702B2

(12) United States Patent
Weaver et al.

(10) Patent No.: US 11,608,702 B2
(45) Date of Patent: Mar. 21, 2023

(54) VARIABLE BLOWOUT PREVENTER APPARATUS AND METHOD

(71) Applicant: National Oilwell Varco, L.P., Houston, TX (US)

(72) Inventors: Randall Ferrain Weaver, McAlester, OK (US); Clifton Dee Eggleston, McAlester, OK (US)

(73) Assignee: National Oilwell Varco, L.P., Houston, TX (US)

( * ) Notice: Subject to any disclaimer, the term of this patent is extended or adjusted under 35 U.S.C. 154(b) by 84 days.

(21) Appl. No.: 17/291,935

(22) PCT Filed: Nov. 7, 2019

(86) PCT No.: PCT/US2019/060199
§ 371 (c)(1),
(2) Date: May 6, 2021

(87) PCT Pub. No.: WO2020/097286
PCT Pub. Date: May 14, 2020

(65) Prior Publication Data

US 2022/0010646 A1 Jan. 13, 2022

Related U.S. Application Data

(60) Provisional application No. 62/757,010, filed on Nov. 7, 2018.

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.1
See application file for complete search history.

(56) References Cited

U.S. PATENT DOCUMENTS 2,855,172 A * 10/1958 Jones ..... E21B 33/062 251/294
3,915,426 A * 10/1975 LeRouax ..... E21B 33/062 251/1.2
5,002,130 A * 3/1991 Laky ..... E21B 33/076 166/54

(Continued)

OTHER PUBLICATIONS

International Search Report and Written Opinion dated Jan. 14, 2020, for Application No. PCT/US2019/060199.

*Primary Examiner* — Daphne M Barry
(74) *Attorney, Agent, or Firm* — Conley Rose, P.C.

(57) ABSTRACT

A blowout preventer includes a housing including a longitudinal passage and a pair of ram passages extending from the longitudinal passage, a first ram assembly disposed in a first of the pair of ram passages and including first ram block assembly, and a second ram assembly disposed in a second of the pair of ram passages and including a second ram block assembly, wherein the first ram block assembly is configured to include a first configuration in which it sealingly engages an outer surface of a tubular member extending through the longitudinal passage of the housing when the blowout preventer is in a closed position, and a second configuration in which it sealingly engages the second ram block assembly when the blowout preventer is in the closed position.

19 Claims, 17 Drawing Sheets

(56) References Cited

U.S. PATENT DOCUMENTS

| | | | | |
|---|---|---|---|---|
| 5,294,088 | A * | 3/1994 | McWhorter | E21B 33/062 251/1.3 |
| 6,089,526 | A * | 7/2000 | Olson | E21B 33/062 251/1.3 |
| 6,223,819 | B1 | 5/2001 | Heinonen | |
| 6,296,225 | B1 * | 10/2001 | Watts | E21B 33/062 251/1.3 |
| 9,238,950 | B2 * | 1/2016 | Schaeper | E21B 33/062 |
| 2004/0262551 | A1 | 12/2004 | Lam | |
| 2007/0175626 | A1 | 8/2007 | Lam | |
| 2011/0140013 | A1 | 6/2011 | Guo | |

* cited by examiner

VARIABLE BLOWOUT PREVENTER APPARATUS AND METHOD

CROSS-REFERENCE TO RELATED APPLICATIONS

The present application is a 35 U.S.C. § 371 national stage application of PCT/US2019/060199 filed Nov. 7, 2019, and entitled "Variable Blowout Preventer Apparatus and Method", which claims benefit of U.S. provisional patent application No. 62/757,010 filed Nov. 7, 2018, and entitled "Variable Blowout Preventer Apparatus and Method" all of which are incorporated herein by reference in their entirety.

STATEMENT REGARDING FEDERALLY SPONSORED RESEARCH OR DEVELOPMENT

Not applicable.

BACKGROUND

Hydrocarbon production systems utilize a downhole pump disposed in a wellbore for pumping fluids from a subterranean earthen formation through production tubing extending from the downhole pump to a surface of the wellbore. In some applications, a blowout preventer (BOP) is installed at a wellhead disposed at a surface of the wellbore, where the BOP is configured to control the inlet and outlet of fluid from the wellbore, and particularly, to confine well fluid in the wellbore in response to a "kick" or rapid influx of formation fluid into the wellbore. The BOP may include both ram BOPs and annular BOPs. Ram BOPs include one or more rams that extend towards the center of the wellbore upon actuation to restrict flow through the ram BOP. In some applications, the inner sealing surface of each ram of the ram BOP is fitted with an elastomeric packer for sealing the wellbore. The ram BOP may include multiple sets of rams (e.g., a set of upper rams and a set of lower rams, etc.). In certain applications, the ram BOP may be periodically pressure tested to ensure the proper functioning of the components of the ram BOP. For example, each set of rams of the ram BOP may be pressure tested before being installed at the wellhead. In at least some applications, at least some of the rams of the ram BOP may need to be removed and reconfigured before being reinstalled in the ram BOP to permit the pressure testing of each of the set of rams of the ram BOP. In certain applications, the ram BOP may be configured to seal against an outer surface of a tubular member extending through the ram BOP. In other applications, the ram BOP may be configured to seal a central passage thereof when no tubular member is present in the ram BOP.

BRIEF SUMMARY OF THE DISCLOSURE

An embodiment of a blowout preventer comprises a housing comprising a longitudinal passage and a pair of ram passages extending from the longitudinal passage, a first ram assembly disposed in a first of the pair of ram passages and comprising first ram block assembly, and a second ram assembly disposed in a second of the pair of ram passages and comprising a second ram block assembly, wherein the first ram block assembly is configured to comprise a first configuration in which it sealingly engages an outer surface of a tubular member extending through the longitudinal passage of the housing when the blowout preventer is in a closed position, and a second configuration in which it sealingly engages the second ram block assembly when the blowout preventer is in the closed position. In some embodiments, the second configuration of the first ram block assembly is circumferentially spaced from the first configuration of the first ram block assembly. In some embodiments, the blowout preventer further comprises an actuator coupled to the first ram block assembly, wherein the actuator is configured to actuate the first ram block assembly between the first configuration and the second configuration. In certain embodiments, the blowout preventer further comprises a locking sleeve disposed about the actuator, wherein the locking sleeve comprises a locked position restricting relative rotation between the first ram block assembly and the housing and an unlocked position permitting relative rotation between the first ram block assembly and the housing. In certain embodiments, the blowout preventer further comprises a stem extending through the actuator and coupled to the first ram block assembly, wherein the stem is configured to actuate the first ram block assembly between a radially inner position and a radially outer position relative a longitudinal axis of the housing. In some embodiments, the first ram block assembly comprises a ram block body comprising a first endface and a second endface opposite the first endface, wherein the second endface comprises a concave sealing surface, and a seal assembly coupled to the ram block body and comprising a rod seal and a plug defining a convex sealing surface, wherein the plug is positioned at the second endface of the ram block body, and the second ram block assembly comprises a ram block body comprising a first endface and a second endface opposite the first endface, wherein the second endface comprises a concave sealing surface, and a seal assembly coupled to the ram block body and comprising a rod seal and a plug defining a convex sealing surface, wherein the plug is positioned at the second endface of the ram block body. In some embodiments, the rod seal of the seal assembly of the first ram block assembly sealingly engages the rod seal of the seal assembly of the second ram block assembly when the first ram block assembly is in the first configuration and the blowout preventer is in the closed position, and the plug of the seal assembly of the first ram block assembly sealingly engages the concave sealing surface of the ram block body of the second ram block assembly when the first ram block assembly is in the second configuration and the blowout preventer is in the closed position. In certain embodiments, the ram block body of the first ram block assembly comprises an axial port extending between the first endface and the second endface and a radial port extending between the axial port and an outer surface of the ram block body extending between the first endface and the second endface.

An embodiment of a blowout preventer comprises a housing comprising a longitudinal passage and a pair of ram passages extending from the longitudinal passage, and a first ram assembly disposed in a first of the pair of ram passages and comprising a first ram block assembly, wherein the first ram block assembly comprises a ram block body comprising a first endface and a second endface opposite the first endface, wherein the second endface comprises a concave sealing surface, and a seal assembly coupled to the ram block body and comprising a plug defining a convex sealing surface, wherein the plug is positioned at the second endface of the ram block body. In some embodiments, the ram block body of the first ram block assembly comprises an axial port extending between the first endface and the second endface and a radial port extending between the axial port and an outer surface of the ram block body extending between the first endface and the second endface. In some embodiments, the blowout preventer further comprises a second ram assembly disposed in a second of the pair of ram passages and comprising a second ram block assembly, wherein the second ram block assembly comprises a ram block body comprising a first endface and a second endface opposite the first endface, wherein the second endface comprises a concave sealing surface and wherein the ram block body comprises an axial port extending between the first endface and the second endface, and a seal assembly coupled to the ram block body and comprising a plug defining a convex sealing surface, wherein the plug is positioned at the second endface of the ram block body. In certain embodiments, the radial port of the ram block body of the first ram block assembly is in fluid communication with the axial port of the ram block body of the second ram block assembly when the blowout preventer is in a closed position. In certain embodiments, the blowout preventer further comprises an actuator coupled to the first ram block assembly, wherein the actuator is configured to actuate the first ram block assembly between a first angular position and a second angular position circumferentially spaced from the first angular position. In some embodiments, the radial port of the ram block body of the first ram block assembly is in fluid communication with a first portion of the central passage extending from the first ram block assembly towards a first end of the housing when the first ram block assembly is in the first angular position, and the radial port of the ram block body of the first ram block assembly is in fluid communication with a first portion of the central passage extending from the first ram block assembly towards a first end of the housing when the first ram block assembly is in the first angular position. In some embodiments, the first ram block assembly comprises a first configuration configured to sealingly engage an outer surface of a tubular member extending through the longitudinal passage of the housing when the blowout preventer is in a closed position, and a second configuration configured to sealingly engage the second ram block assembly when the blowout preventer is in the closed position. In some embodiments, the blowout preventer further comprises an actuator coupled to the first ram block assembly, wherein the actuator is configured to actuate the first ram block assembly between the first configuration and the second configuration.

An embodiment of a method for operating a blowout preventer comprises (a) actuating the blowout preventer into a first closed position in which a first ram block assembly of a first ram assembly and a second ram block assembly of a second ram assembly seal against a tubular member extending through a longitudinal passage of the blowout preventer, (b) actuating the first ram block assembly from a first configuration to a second configuration, and (c) actuating the blowout preventer into a second closed position with the first ram block assembly sealing against the second ram block assembly. In some embodiments, (b) comprises applying a torque to an actuator that is rotatably locked to the first ram block assembly to rotate the first ram block assembly from a first angular position to a second angular position. In some embodiments, the method further comprises (c) displacing a locking sleeve from a locked position to an unlocked position to permit relative rotation between the actuator and a housing of the first ram assembly. In certain embodiments, (c) comprises sealingly engaging a plug of a sealing assembly of the first ram block assembly with a concave sealing surface of a ram block body of the second ram block assembly.

BRIEF DESCRIPTION OF THE DRAWINGS

For a detailed description of exemplary embodiments, reference will now be made to the accompanying drawings in which.

DETAILED DESCRIPTION OF THE DISCLOSED EMBODIMENTS

Figure 1:
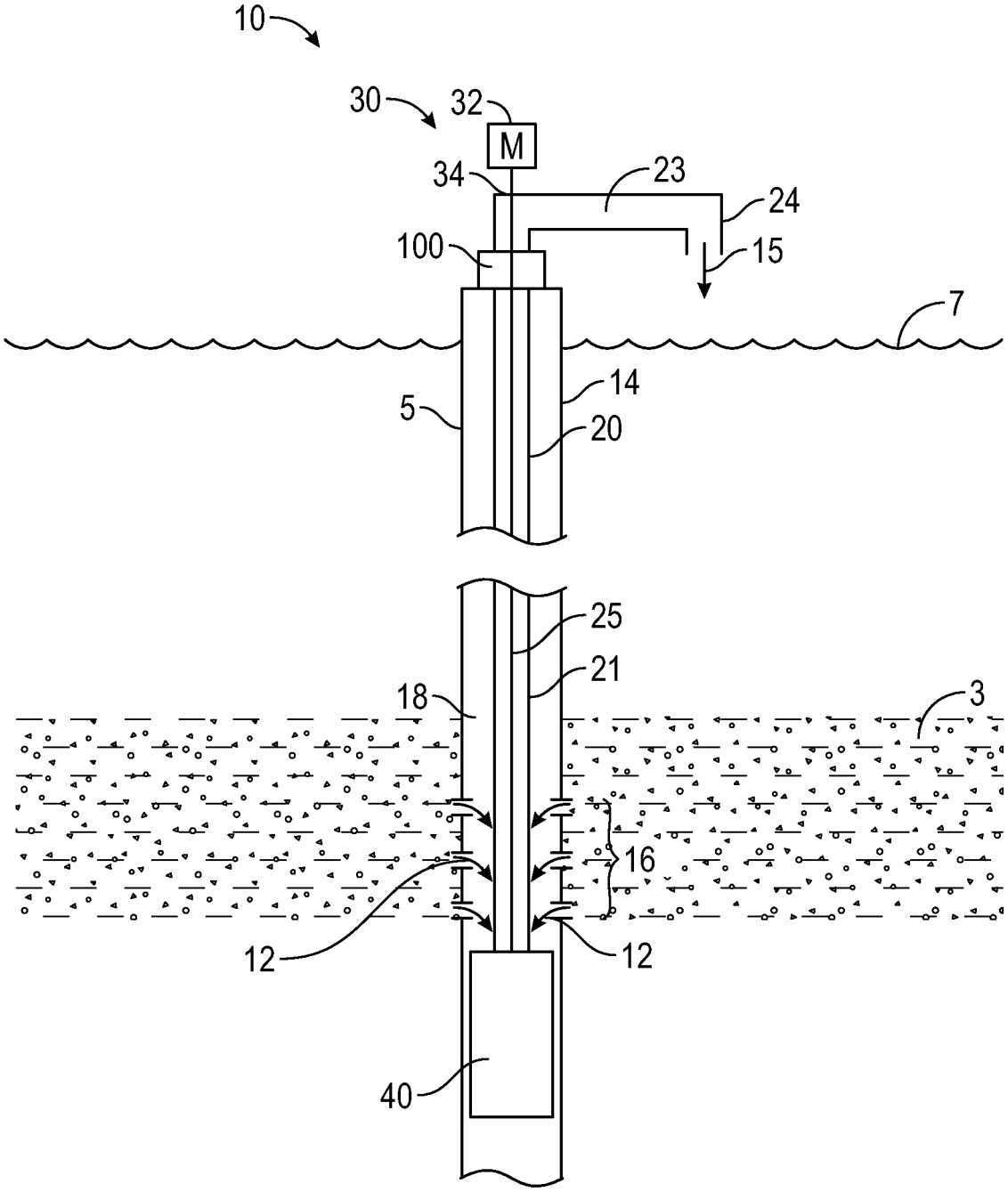
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms “including” and “comprising”

are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, a well or production system 10 is shown. Production system 10 is generally configured for extracting hydrocarbon bearing reservoir fluid (indicated by arrow 12 in FIG. 1) from a subsurface reservoir 3 via a wellbore 5 that extends through the subsurface reservoir 3 from the surface 7. Though shown as vertical in FIG. 1, in general, wellbore 5 may have generally vertical portions or generally horizontal portions and may have curved portions between various portions. In the embodiment of FIG. 1, production system 10 includes a tubular casing 14, which may be a metal pipe for example, is positioned and cemented in wellbore 5. Casing 14 has a set of perforations 16 at a location corresponding to subsurface reservoir 3 to provide for fluid communication between subsurface reservoir 3 and a central passage 18 of casing 14.

In this embodiment, production system 10 additionally includes production tubing 20 that extends into casing 14 from the surface 7, an extension shaft or rod 25 that extends into and through production tubing 20 from a set of exterior surface equipment 30 positioned at the surface 7, and a positive displacement device or pump 40. Pump 40 is coupled to the lower ends of production tubing 20 and is positioned within casing 14 and wellbore 5 at a selected depth below the surface 7. Production tubing 20 includes a lower end 21 within casing 14 and wellbore 5, and an upper end 23 opposite lower end 21 that may extend above the surface 7, where upper end 23 terminates at a discharge port 24. The discharge port 24 of production tubing 20 is routed to a convenient location to release an outlet stream 15 of fluid produced from subsurface reservoir 3.

Surface equipment 30 of production system 10 includes a source of rotational or reciprocating power, which is motor 32 in this embodiment, a shaft bearing 34, and other equipment known in the art. Extension rod 25 may also be called a rod string and is coupled between pump 40 and motor 32 to transmit rotational or reciprocating power from motor 32 to pump 40. In this embodiment, motor 32 is positioned outside the production tubing 20 and outside the wellbore 5, and the fluid-tight shaft bearing 34 allows extension rod 25 to extend into production tubing 20 without a loss of reservoir fluid 12. During operation of production system 10, fluid 12 from subsurface reservoir 3 enters casing 14 through perforations 16, where the reservoir fluid 12 enters pump 40 suspended within casing 14. Pump 40 discharges the reservoir fluid 12 into the lower end 21 of production tubing 20, though which the reservoir fluid 12 flows to the surface 7 and is discharged from the upper end 23 of production tubing 20 at discharge port 24 as outlet stream 15.

Surface equipment 30 of production system 10 additionally includes a variable ram blowout preventer (BOP) 100 coupled to a wellhead affixed to an upper end of casing 14. In this embodiment, variable ram BOP 100 comprises an internal variable ram BOP 100 configured to selectably seal against an outer surface of extension rod 25 to thereby isolate the lower end 21 of production tubing 20 from the upper end 23. Thus, in the event of an uncontrolled influx of reservoir fluid 12 into wellbore 5, an operator of production system 10 may actuate variable ram BOP 100 to seal wellbore 5 (including the lower end 21 of production tubing 20 from the surrounding environment. Although in this embodiment variable ram BOP 100 comprises an internal variable ram BOP 100 of a production system 10, in other embodiments, variable ram BOP 100 may comprise a variable ram BOP 100 for use in a drilling system for sealing either a drill string or an annulus formed in a wellbore.

As will be described further herein, in this embodiment, variable ram BOP 100 is configured to seal wellbore 5 from the surrounding environment both when extension rod 25 is inserted in variable ram BOP 100 and wellbore 5 and when extension rod 25 has been removed from wellbore 5, such as when maintenance is being performed on extension rod 25 and/or pump 40, when reservoir 3 is being hydraulically fractured from a separate wellbore, and when wellbore 5 has been temporarily abandoned. In other words, variable ram BOP 100 includes a first or "rod" configuration" that is configured to seal wellbore 5 from the surrounding environment when a tubular member (e.g., extension rod 25) extends through variable ram BOP 100, and a second or "blind" configuration that is configured to seal wellbore 5 from the surrounding environment when no tubular member extends through variable ram BOP 100.

Figure 2:
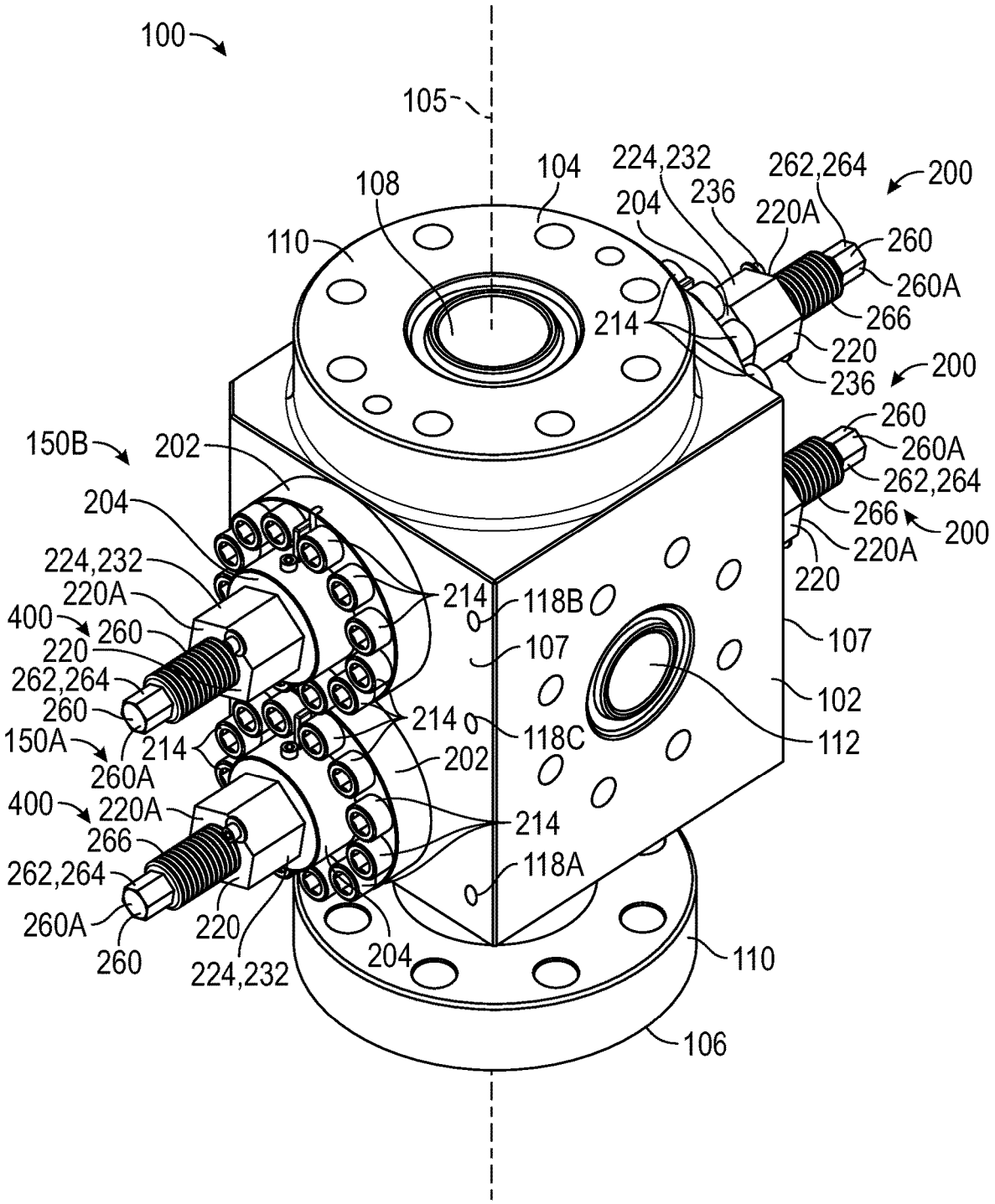
FIG. 2 is a perspective view of an embodiment of a ram BOP of the well system of FIG. 1 in accordance with principles disclosed herein.
Figure 3:
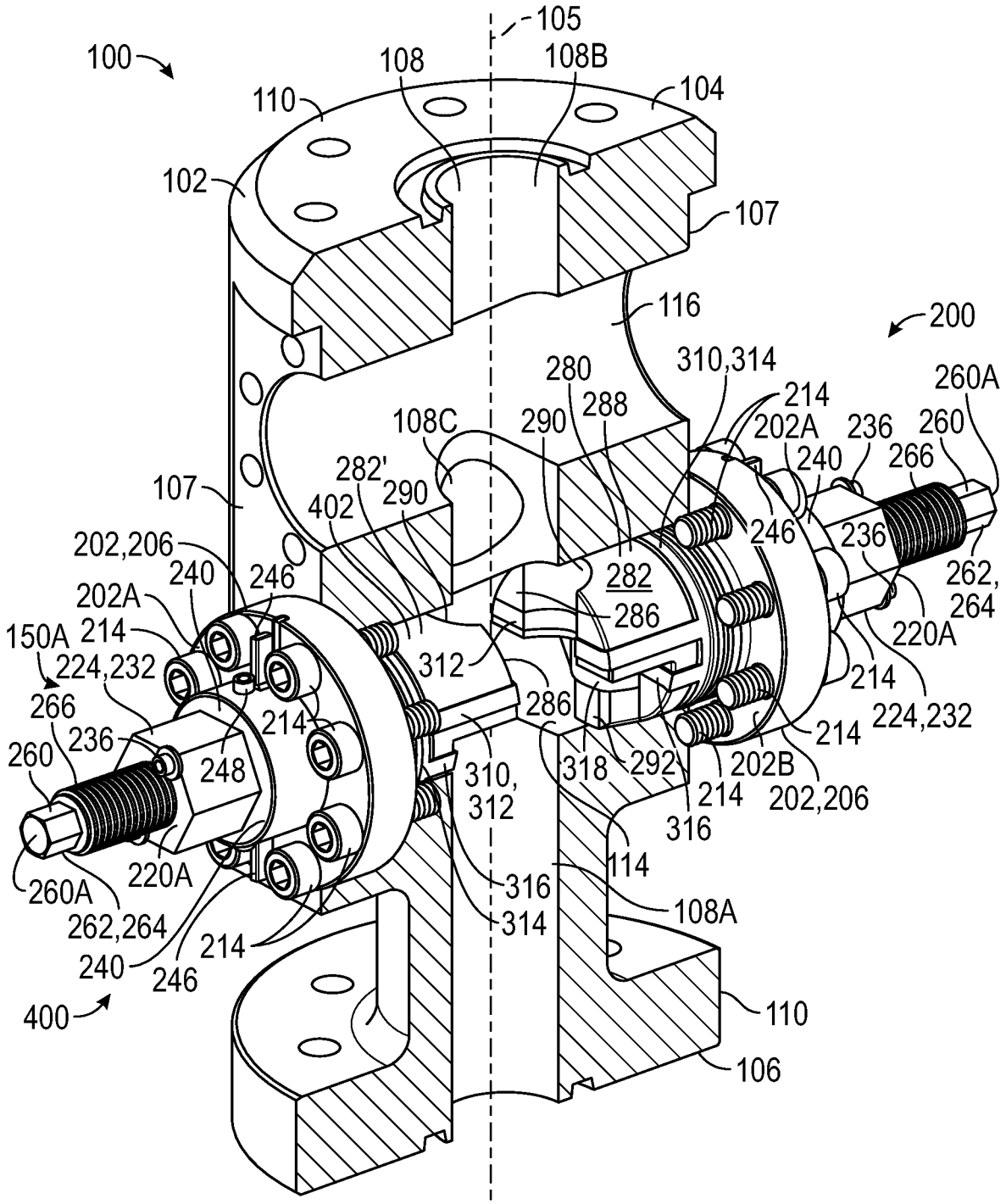
FIG. 3 is a perspective cross-sectional view of the ram BOP of FIG. 2 in a first position.
Figure 4:
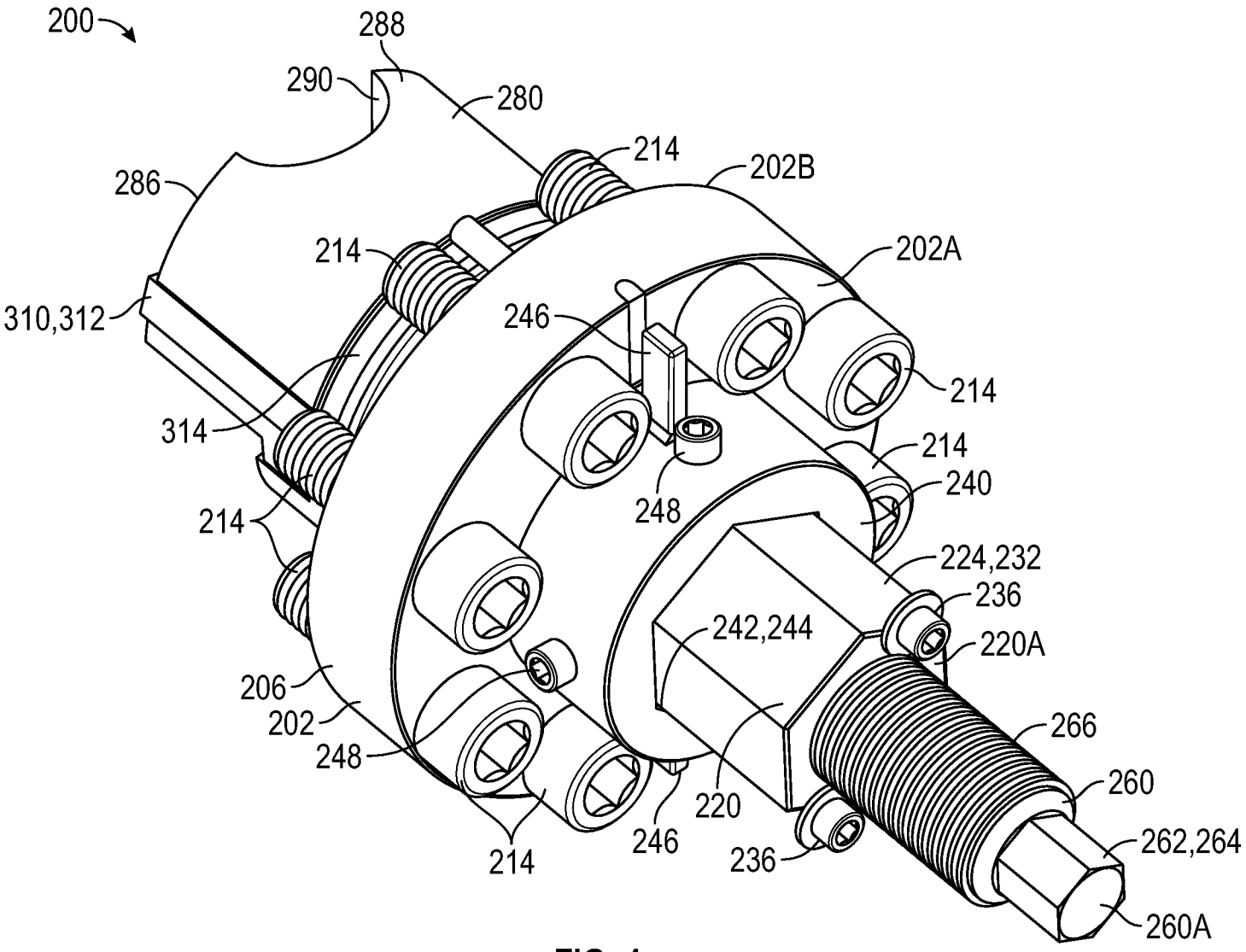
FIG. 4 is a perspective view of an embodiment of a first ram assembly of the ram BOP of FIG. 2 in a first configuration in accordance with principles disclosed herein.
Figure 5:
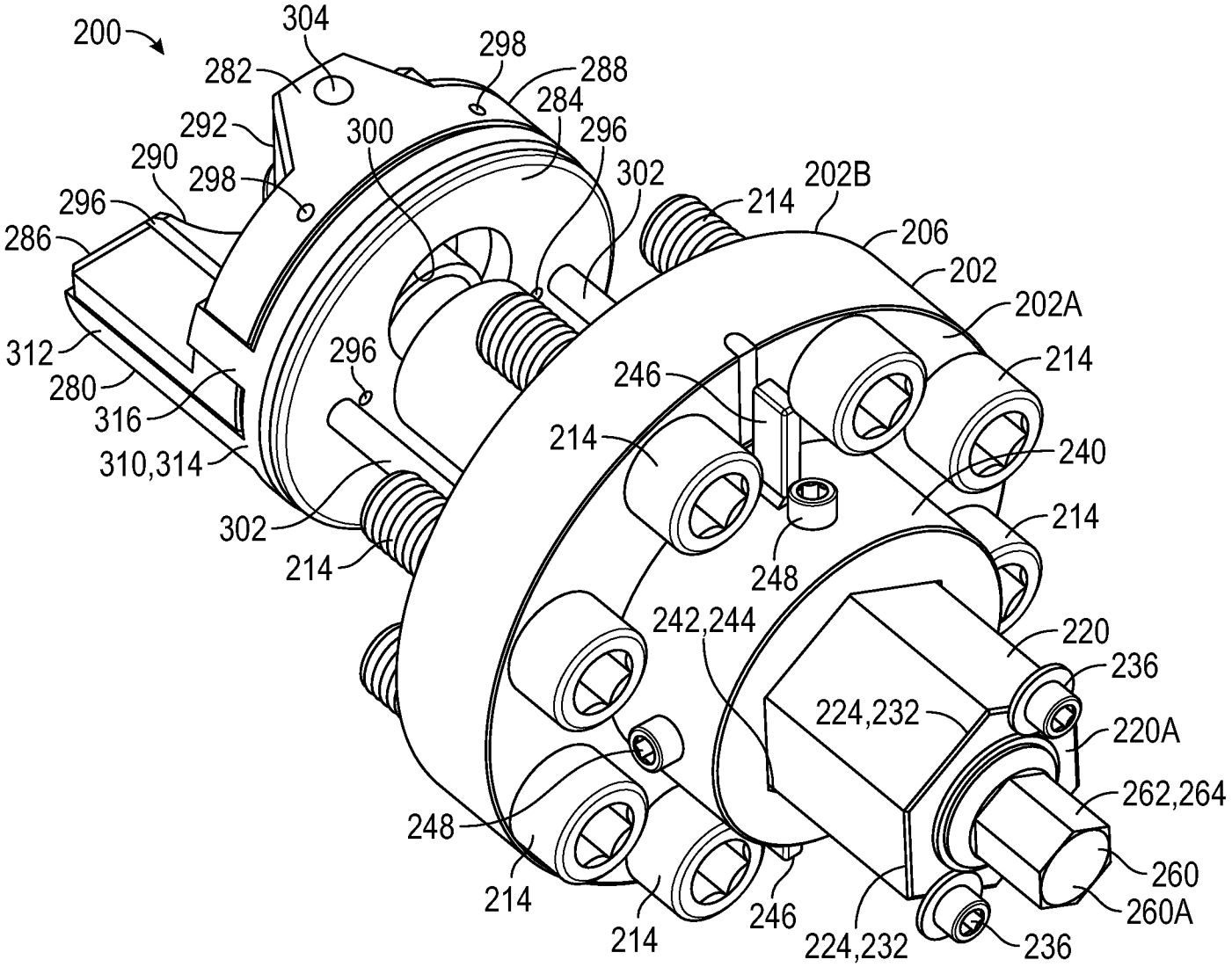
FIG. 5 is a perspective view of the first ram assembly of FIG. 4 in a second configuration.
Figure 6:
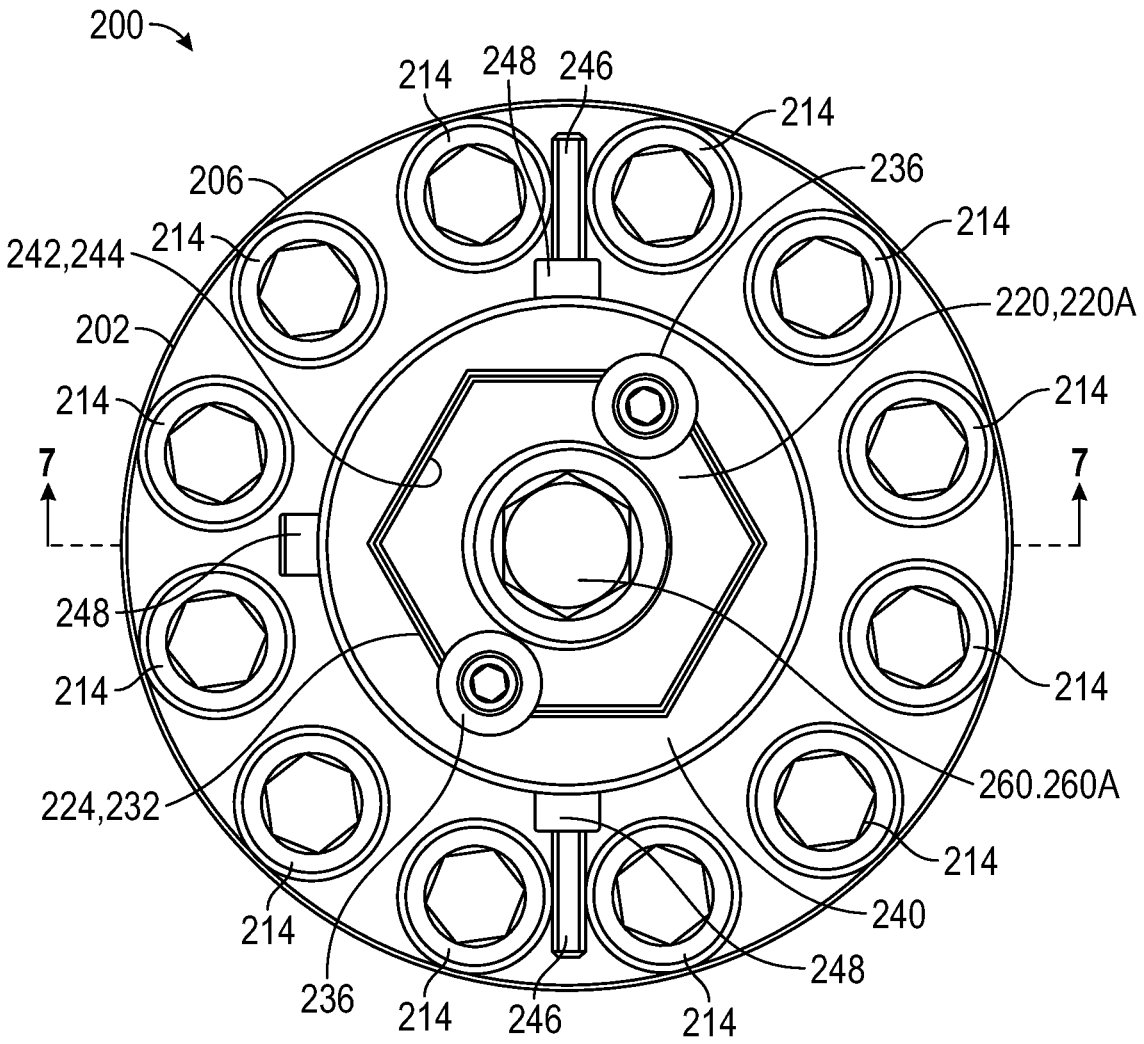
FIG. 6 is a front view of the ram assembly of FIG. 4.
Figure 7:
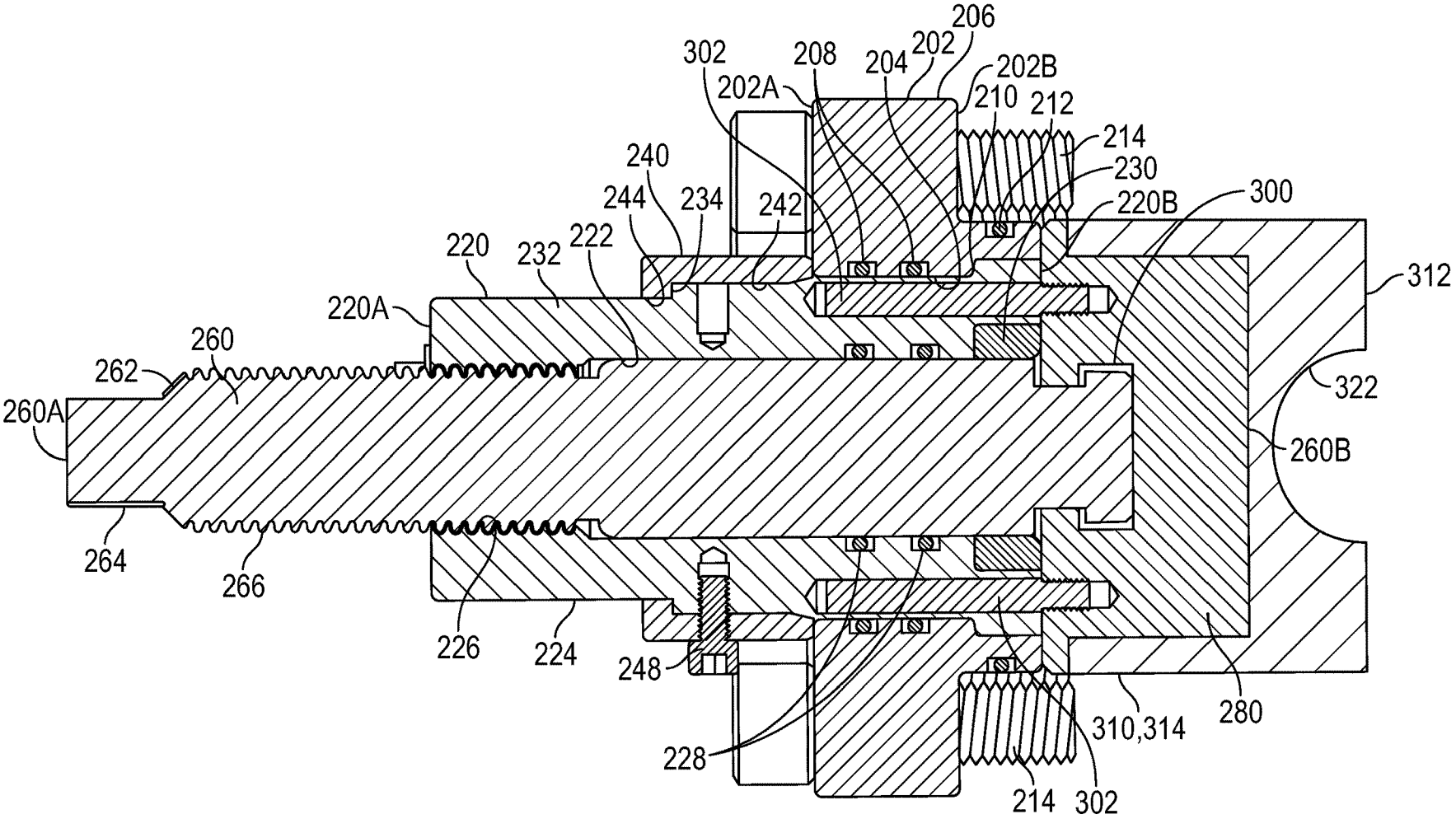
FIG. 7 is a cross-sectional view along lines 7-7 of FIG. 6 of the ram assembly of FIG. 4.
Figure 8:
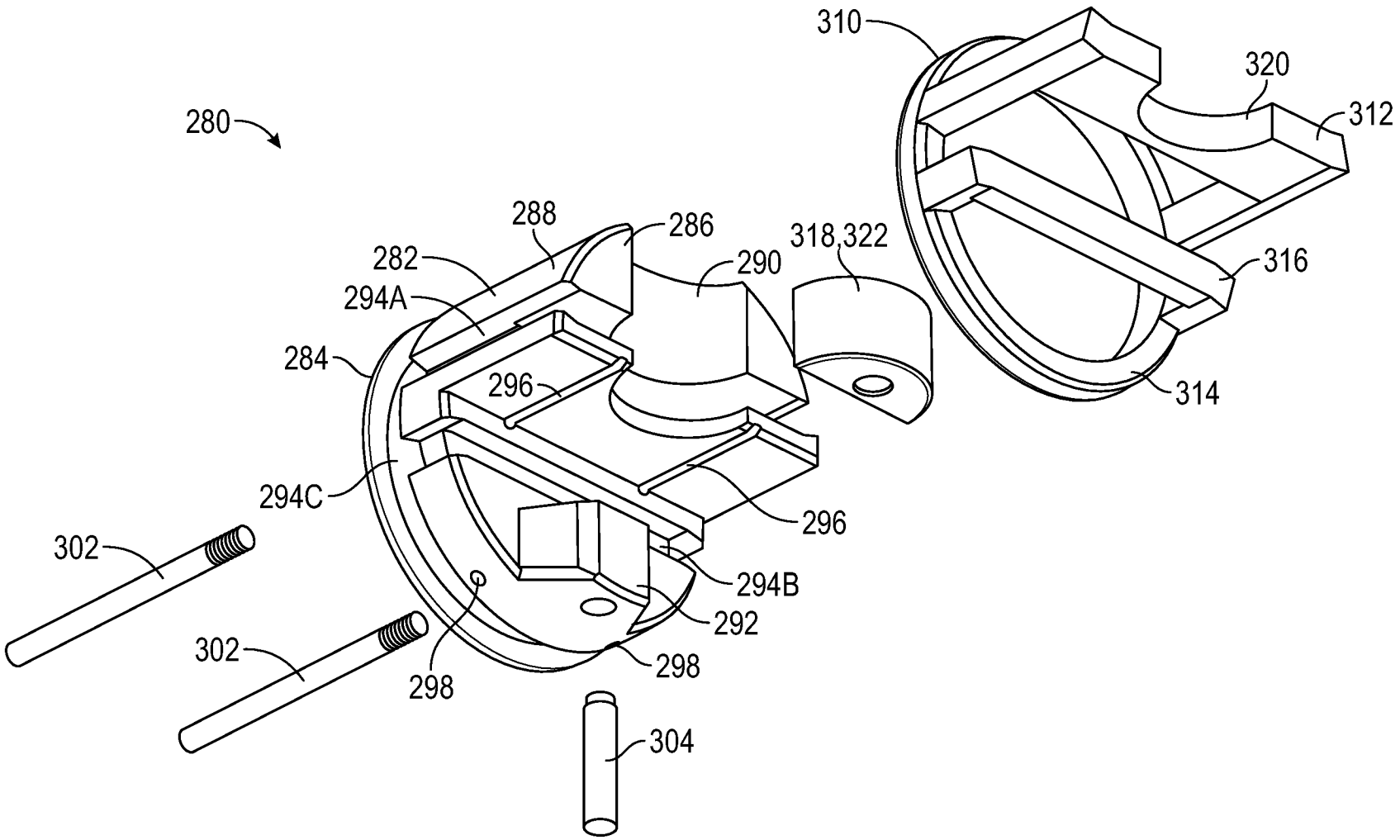
FIG. 8 is an exploded view of an embodiment of a first ram block assembly of the first ram assembly of FIG. 4 in accordance with principles disclosed herein.
Figure 9A:
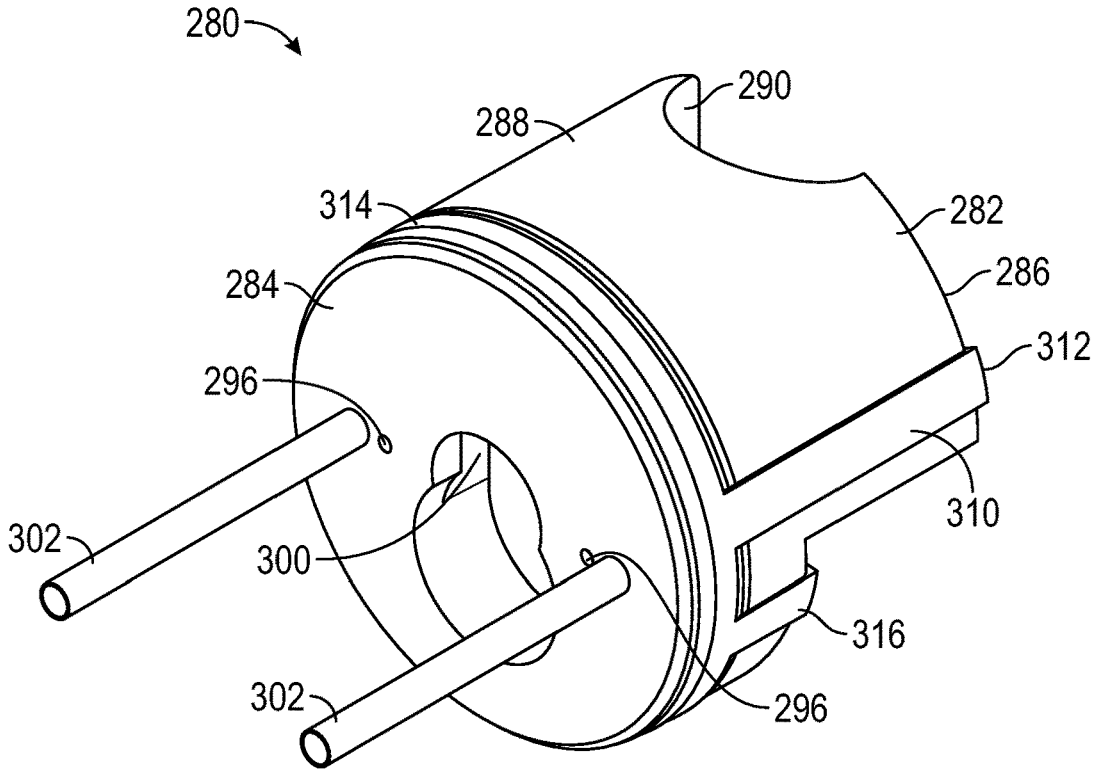
FIGS. 9A and 9B are perspective views of the first ram block assembly of FIG. 8.
Figure 9B:
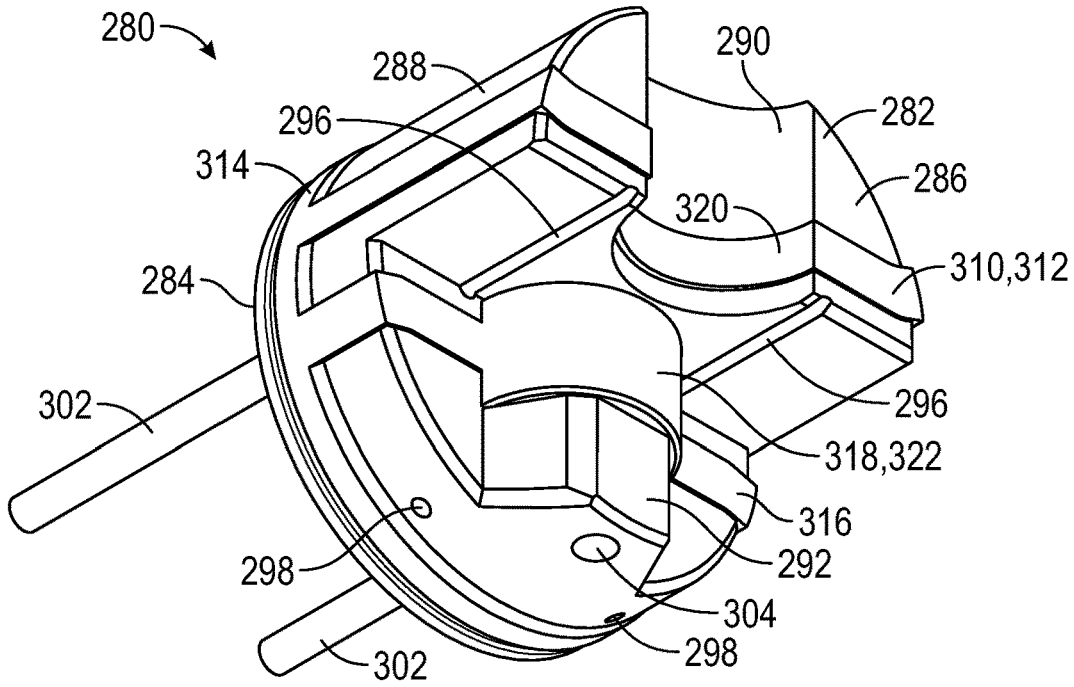
Figure 9C:
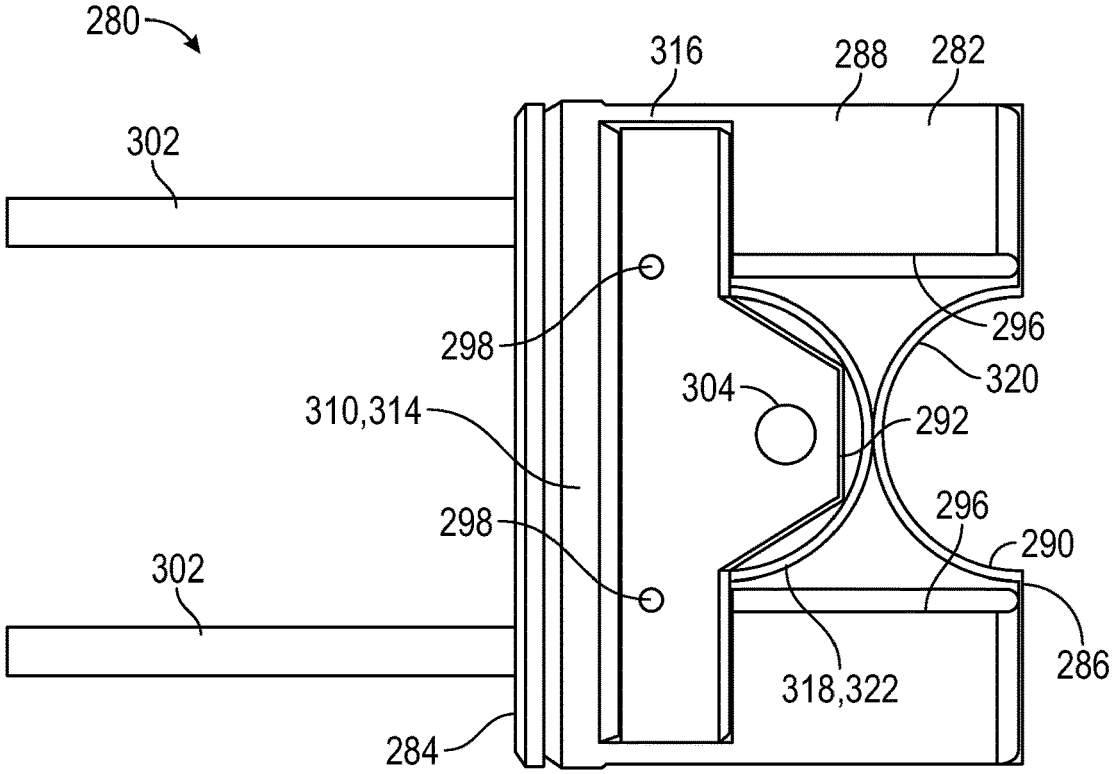
FIG. 9C is a bottom view of the ram block assembly of FIG. 8.
Figure 9D:
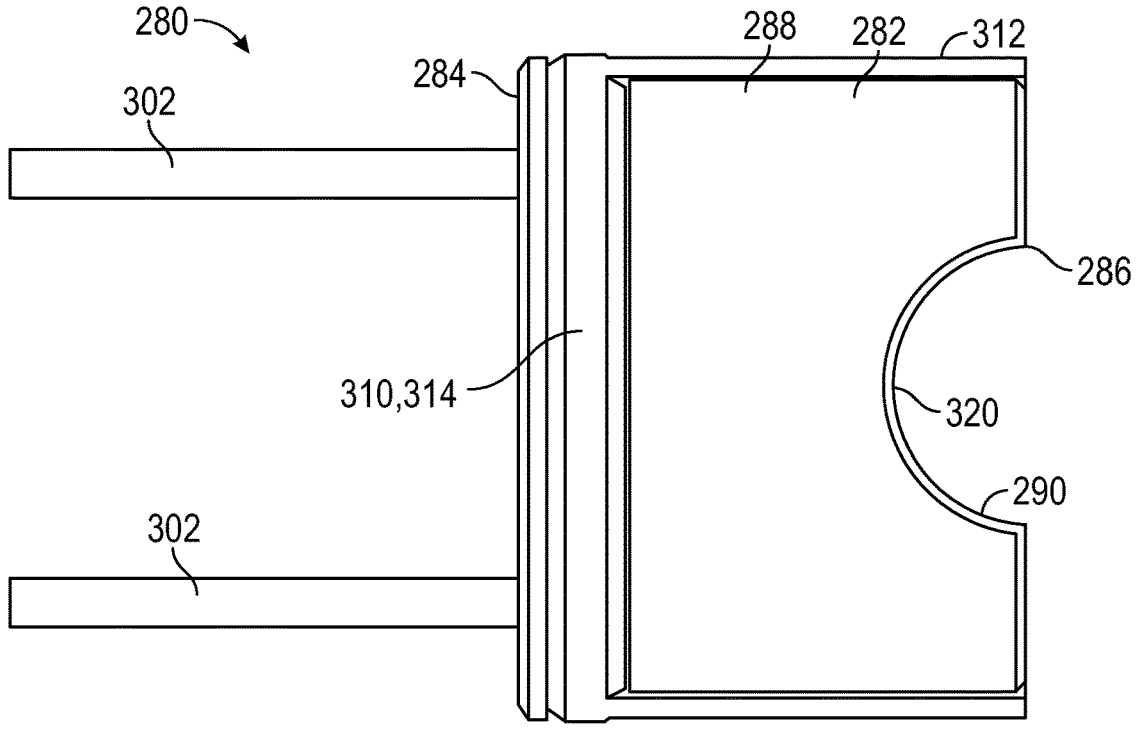
FIG. 9D is a top view of the ram block assembly of FIG. 8.
Figure 9E:
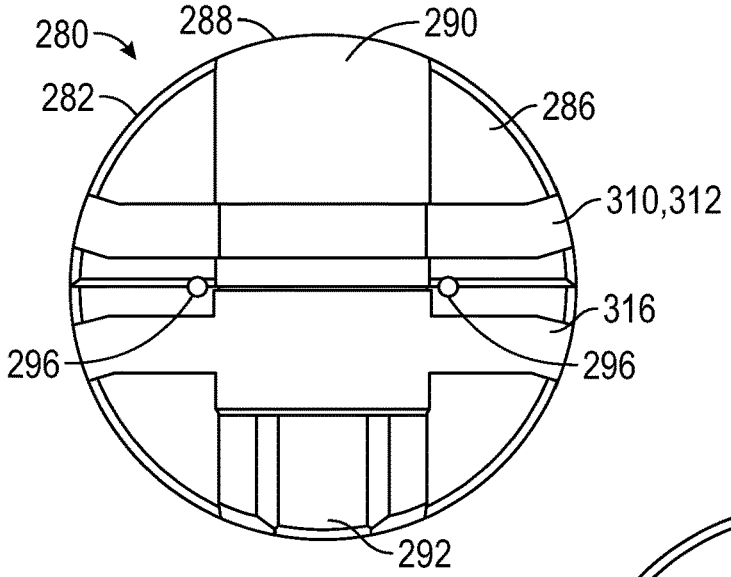
FIG. 9E is a rear view of the ram block assembly of FIG. 8.
Figure 9F:
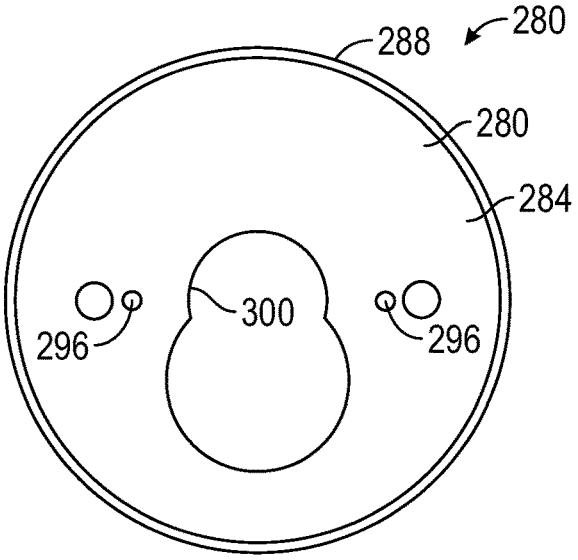
FIG. 9F is a front view of the ram block assembly of FIG. 8.
Figure 9G:
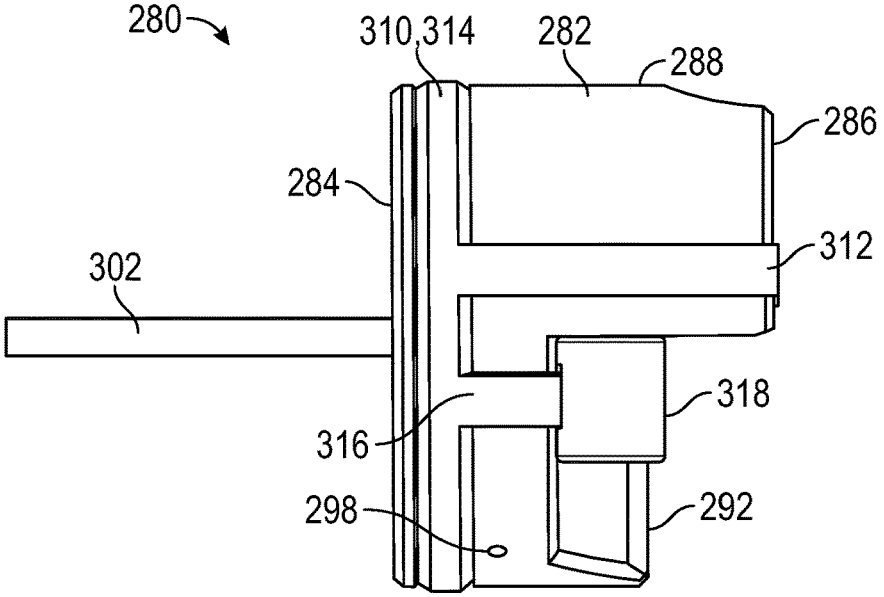
FIG. 9G is a side view of the ram block assembly of FIG. 8.

Referring to FIGS. 2, 3, an embodiment of the variable ram BOP 100 of production system 10 is shown. In the embodiment of FIGS. 2, 3, annular BOP 100 has a central or longitudinal axis 105 and generally includes a housing or housing 102, a first or lower set 150A of ram assemblies 200, 400, and a second or upper set 150B of ram assemblies 200, 400 that are axially spaced from the lower set 150A. Particularly, each set 150A, 150B includes a single first ram assembly 200 disposed directly adjacent a first of the lateral sides 107 of housing 102, and a single second ram assembly 400 positioned opposite the first ram assembly 200 directly adjacent a second of the lateral sides 107 of housing 102. Although in this embodiment variable ram BOP 100 includes two sets 150A, 150B of ram assemblies 200, 400, in other embodiments, the number of sets of axially spaced ram assemblies 200, 400 may vary.

In this embodiment, the housing 102 of variable ram BOP 100 includes a first or upper end 104, a second or lower end 106 opposite upper end 104, a pair of lateral sides 107, and a central or longitudinal passage 108 extending between ends 104, 106. Housing 102 includes flange connectors 110 at each end 104, 106 for connecting variable ram BOP 100 with other components of production system 10. In this embodiment, housing 102 includes one or more radial ports 112 in fluid communication with central passage 108. Port 112 may be attached to a choke or kill line for communicating fluid to and from the central passage 108 of housing 102. Additionally, housing 102 includes a pair of first or lower ram passages 114 (shown in FIG. 3) which receive at least a portion of the lower set 150A of ram assemblies 200, 400, and a pair of second or upper ram passages 116 which receive at least a portion of the upper set 150B of ram assemblies 200, 400. In this embodiment, housing 102 further includes a plurality of axially spaced test ports 118A-118C, each of which are in fluid communication with central passage 108.

Referring to FIGS. 2-9G, FIGS. 4-9G illustrate one of the first ram assemblies 200 of variable ram BOP 100 shown in FIGS. 2, 3. In the embodiment of FIGS. 2-9G, first ram assembly 200 generally includes a generally cylindrical housing 202, a cylindrical actuator 220, a locking sleeve 240, an elongate stem 260, and a variable first ram block assembly 280. As shown particularly in FIG. 7, housing 202 of the first ram assembly 200 includes a first or outer end 202A, a second or inner end 202B opposite outer end 202A, a central bore or passage defined by a generally cylindrical inner surface 204 extending between ends 202A, 202B, and a generally cylindrical outer surface 206 extending between ends 202A, 202B. In this embodiment, the inner surface 204 of housing 202 includes a pair of seal assemblies 208, each seal assembly 208 comprising a seal groove and a pair of annular seals disposed therein. Additionally, the inner surface 204 of housing 202 also includes an annular shoulder 210. In this embodiment, the outer surface 206 of housing 202 includes an annular seal assembly 212 comprising a seal groove and a pair of annular seals disposed therein. Seal assembly 212 is configured to sealingly engage the inner surface of either the lower ram passage 114 (in the case of the first ram assembly 200 of lower set 150A) or the upper ram passage 116 (in the case of the first ram assembly 200 of upper set 150B) of housing 102. A plurality of circumferentially spaced releasable or threaded fasteners 214 extend through housing 202, threaded fasteners 214 configured to releasably couple ram assembly 200B with the housing 102 of variable ram BOP 100.

The actuator 220 of first ram assembly 200 includes a first or outer end 220A, a second or inner end 220B opposite outer end 220A, a central bore or passage defined by a generally cylindrical inner surface 222 extending between ends 220A, 220B, and a generally cylindrical outer surface 224 extending between ends 220A, 220B. In this embodiment, the inner surface 222 of actuator 220 includes a threaded portion or connector 226 extending from outer end 220A, and a pair of seal assemblies 228 spaced from threaded connector 226, each seal assembly 228 comprising a seal groove and a pair of annular seals disposed therein. Additionally, the inner surface 222 of actuator 220 includes an annular guide bushing 230 positioned at inner end 220B that acts as a bearing for assisting with relative rotation between stem 260 and actuator 220. In this embodiment, the outer surface 224 of actuator 220 includes a plurality of circumferentially spaced planar surfaces forming a hexagonal surface or portion 232 extending from outer end 220A and an annular shoulder 234. Additionally, in this embodiment, one or more retainers 236 extend into the outer end 220A of actuator 220, where retainers 236 extend radially outwards from outer surface 224 to prevent locking sleeve 240 from becoming completely disengaged from actuator 220.

The locking sleeve 240 of first ram assembly 200 is generally cylindrical and includes a central bore or passage defined by an inner surface 242 extending between opposite axial ends of locking sleeve 240, and a generally cylindrical outer surface extending between the opposite axial ends of locking sleeve 240. In this embodiment, the inner surface 242 of locking sleeve 240 includes a hexagonal portion or surface 244 configured to matingly engage the hexagonal surface 232 of actuator 220. Additionally, the outer surface of locking sleeve 240 includes a plurality of circumferentially spaced locking tabs 246 positioned proximal an inner end of locking sleeve 240, where each locking tab extends radially outwards from the outer surface of locking sleeve 240.

In this embodiment, locking sleeve 240 includes a first or locked position (shown in FIGS. 4-7) where hexagonal surface 244 matingly engages the hexagonal surface 232 of actuator 220 to restrict relative rotation between locking sleeve 240 and actuator 220. Additionally, when locking sleeve 240 is disposed in the locked position, locking tabs 246 are each positioned between adjacent fasteners 214, thereby restricting relative rotation between locking sleeve 240 and housing 202 and locking the angular position of locking sleeve 240 and actuator 220. When locking sleeve 240 is disposed in the locked position, a plurality of circumferentially spaced locking pins 248 may be inserted radially through locking sleeve 240 and into the outer surface 232 of actuator 220 to lock the locking sleeve 240 in the locked position. Locking sleeve 240 also includes a second or unlocked position spaced from the locked position where an outer end of locking sleeve 240 is disposed adjacent retainers 236 and hexagonal surface 244 is disengaged from the hexagonal surface 232 of actuator 220, thereby permitting relative rotation between locking sleeve 240 and actuator 220. Additionally, when locking sleeve 240 is in the unlocked position, relative rotation is permitted between actuator 220 and housing 202.

Stem 260 of ram block assembly 200B has a first or outer end 260A, a second or inner end 260B opposite outer end 260A, and a generally cylindrical outer surface 262 extending between ends 260A, 260B. In this embodiment, outer surface 262 of stem 260 includes a hexagonal portion or surface 264 extending from outer end 260A, a threaded portion or connector 266 extending from hexagonal surface 264 that threadably connects with the threaded connector 226 of actuator 220. Hexagonal surface 264 of stem 260 is configured to interface with a tool (e.g., a wrench) such that torque may be conveniently applied to stem 260. While in this embodiment stem 260 includes hexagonal surface 264, in other embodiments, stem 260 need not include hexagonal surface 264 and may instead, for example, include other mechanisms for permitting the convenient application of torque thereto. The outer surface 262 of stem 260 is sealingly engaged by the seal assemblies 228 of actuator 220, restricting fluid communication across the annular interface formed between stem 260 and actuator 220. In this embodiment, the outer surface 262 of stem 260 also includes a releasable connector 270 positioned at the inner end 260B thereof for releasably coupling stem 260 with ram block 280.

As shown particularly in FIGS. 7-9G, the first ram block assembly 280 of first ram assembly 200 generally includes a ram block body 282, and a seal assembly 310 coupled to the ram block body 282. In this embodiment, the ram block body 282 of first ram block assembly 280 has a first or outer end defined by an outer endface 284, a second or inner end opposite the outer end that is defined by an inner endface 286, and a curved outer surface 288 extending between endfaces 284, 286. A portion of the inner endface 286 of ram block body 282 comprises a curved, concave surface 290. Additionally, a portion of the inner endface 286 comprises a protrusion 292 that is spaced from concave surface 290. As shown particularly in FIG. 8, ram block body 282 includes a plurality of seal grooves including a first seal groove 294A and a second seal groove 294B, each formed in the inner endface 286. Additionally, ram block body 282 includes a circumferential seal groove 294C formed in outer surface 288 and positioned proximal the outer endface 284, where circumferential seal groove 294C extends about the entire circumference of ram block body 282.

In this embodiment, the ram block body 282 of first ram block assembly 280 includes a first pair of pressure balancing ports 296 that extend axially between endfaces 284, 286. Axial ports 296 of ram block body 282 are positioned such that they intersect the inner endface 286 of ram block body 282 at a location positioned between first seal groove 294A and second seal groove 294B. Ram block body 282 also includes a second pair of pressure balancing ports 298 that extend radially from outer surface 288 and intersect axial ports 296, thereby providing fluid communication between axial ports 296 and radial ports 298. A releasable connector 300 is formed in the outer endface 284 for releasably connecting ram block 280 with stem 260. Additionally, the ram block body 282 couples with actuator 220 via a pair of circumferentially spaced pins 302 that extend between the outer endface 284 of ram block body 282 and the inner end 220B of actuator 220 to thereby rotationally lock first ram block assembly 280 with actuator 220.

As shown particularly in FIGS. 7-9G, the seal assembly 310 of first ram block assembly 280 generally includes a rod seal 312, a circumferential seal 314, a blind seal 316, and a blind seal plug 318. In this embodiment, seal assembly 310 is assembled with ram block body 282 to form first ram block assembly 280 by coupling plug 318 with ram block body 282 via a pin 304 that is inserted through protrusion 292. Subsequently, rod seal 312, circumferential seal 314, and blind seal 316 are coupled or fitted to ram block body 282, with blind seal 316 being coupled to plug 318. However, in other embodiments, seal assembly 310 may be assembled with ram block body 282 in varying ways. In this embodiment, rod seal includes a curved, convex sealing surface 320 while plug 318 includes a curved, concave sealing surface 322. When seal assembly 310 is assembled with ram block body 282, rod seal 312 is received in first seal groove 294A, circumferential seal 314 is received in circumferential seal groove 294C, and blind seal 316 is received in the second seal groove 294B of ram block body 282. Both rod seal 312 and blind seal 316 extend between the inner endface 286 of ram block body 282 and the circumferential seal 314 when seal assembly 310 is assembled with ram block body 282.

Figure 10:
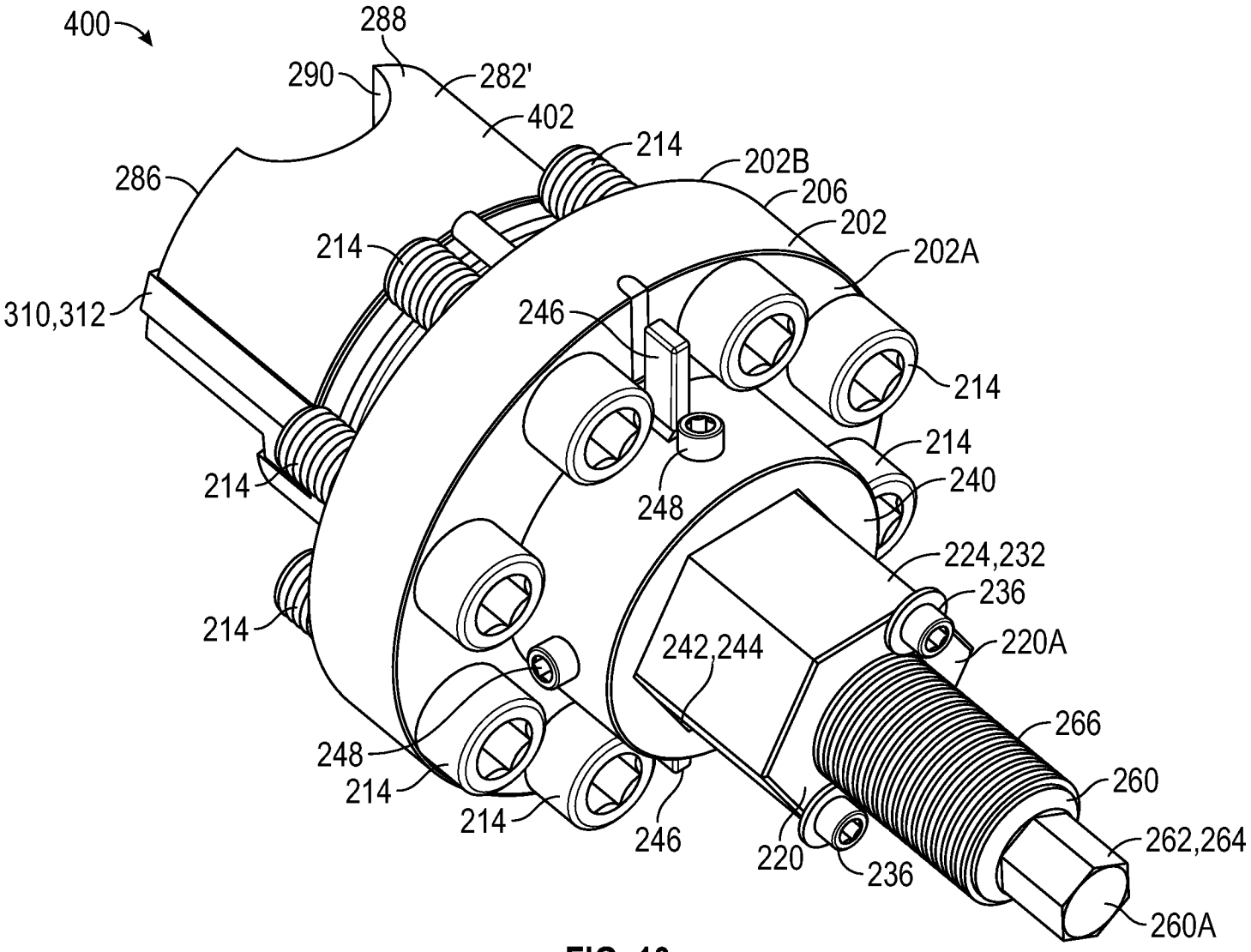
FIG. 10 is a perspective view of an embodiment of a second ram assembly of the ram BOP of FIG. 2 in a first configuration in accordance with principles disclosed herein.
Figure 11:
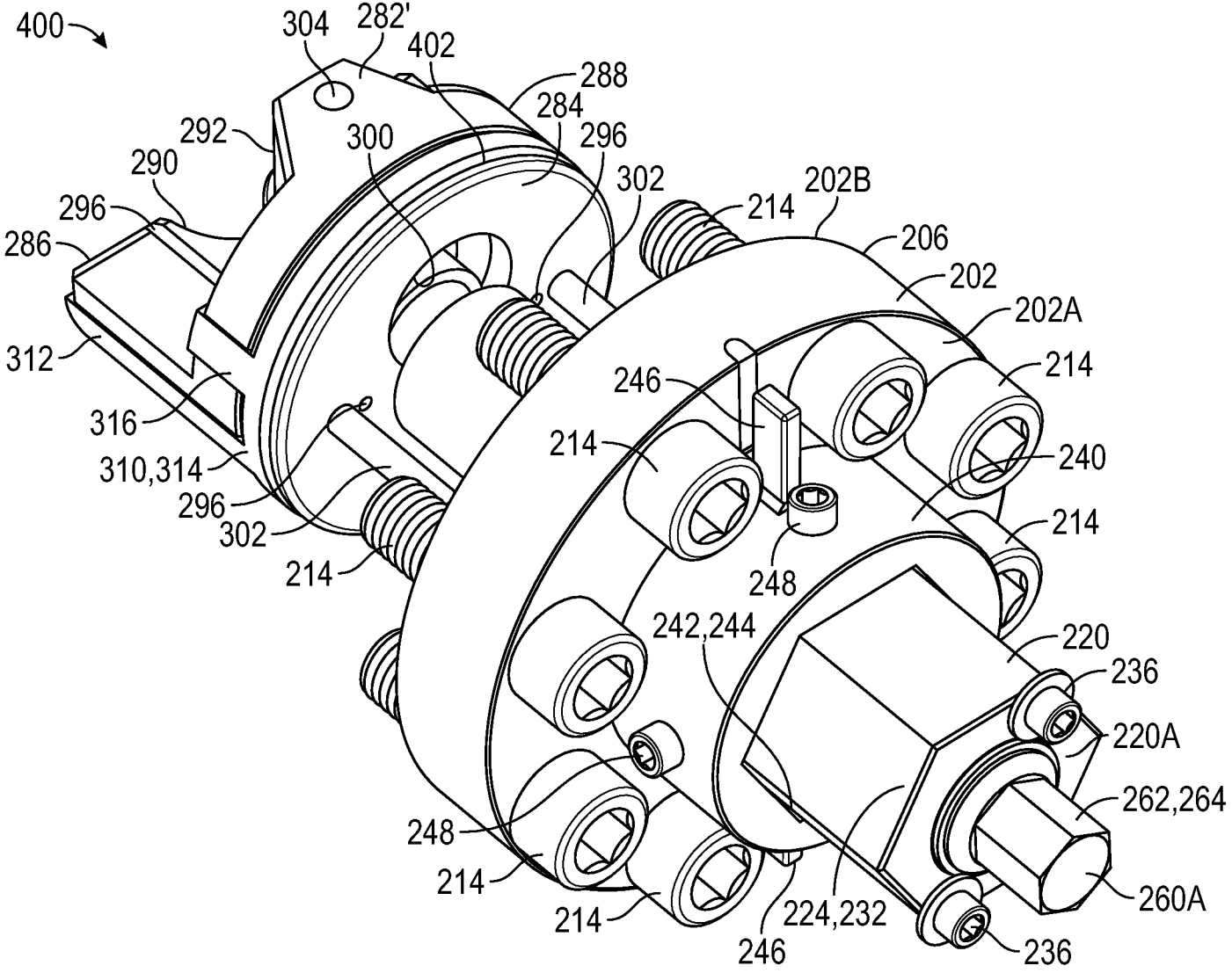
FIG. 11 is a perspective view of the second ram assembly of FIG. 10 in a second configuration.

Referring to FIGS. 2, 3, 10, and 11, one of the second ram assemblies 400 of variable ram BOP 100 of FIGS. 2, 3 is shown in FIGS. 10, 11. Second ram assembly 400 includes features in common with the first ram assembly 200 shown in FIGS. 2-9G, and shared features are labeled similarly. Particularly, in the embodiment of FIGS. 2, 3, 10, and 11, the second ram assembly 400 generally includes housing 202, actuator 220, locking sleeve 240, stem 260, and a variable second ram block assembly 402. Second variable ram block assembly 402 comprises a ram block body 280' and seal assembly 310 coupled thereto. The ram block body 280' of second ram block assembly 402 is similar to the ram block body 280 of first ram block assembly 402 except that ram block body 280' only includes axial ports 296, and thus, does not include radial ports 298.

Referring to FIGS. 2-15, as described above, variable ram BOP 100 includes a rod configuration that is configured to selectively seal against an outer surface of a tubular member, and a blind configuration that is configured to selectively prevent fluid flow or communication through the variable ram BOP 100 when no tubular member is extending through the variable ram BOP 100. Particularly, when in the rod configuration, variable ram BOP 100 includes a first or open rod position shown in FIG. 3 and a second or closed rod position shown in FIG. 12. For clarity, only the lower set 150B of ram assemblies 200, 400 are shown in FIGS. 3 and 12-15 (upper set 150B is hidden). In the open rod position, variable ram BOP 100 is configured to permit fluid flow or communication through central passage 108 of housing 102 via an annulus formed between the outer surface of the tubular member (e.g., extension rod 25) extending through variable ram BOP 100 and the inner surface of central passage 108. Particularly, in the open rod position of variable ram BOP 100, the inner endface 286 of the ram block body 282 of first ram assembly 200 is disposed in a first or radially outer position that is radially spaced from the inner endface 286 of the ram block body 282' of second ram assembly 400, which is also disposed in a first or radially outer position. Although hidden in FIG. 3, the upper set 150B of ram assemblies 200, 400 is configured similarly as the lower set 150A of ram assemblies 200, 400 when variable ram BOP 100 is in the open rod position.

Figure 12:
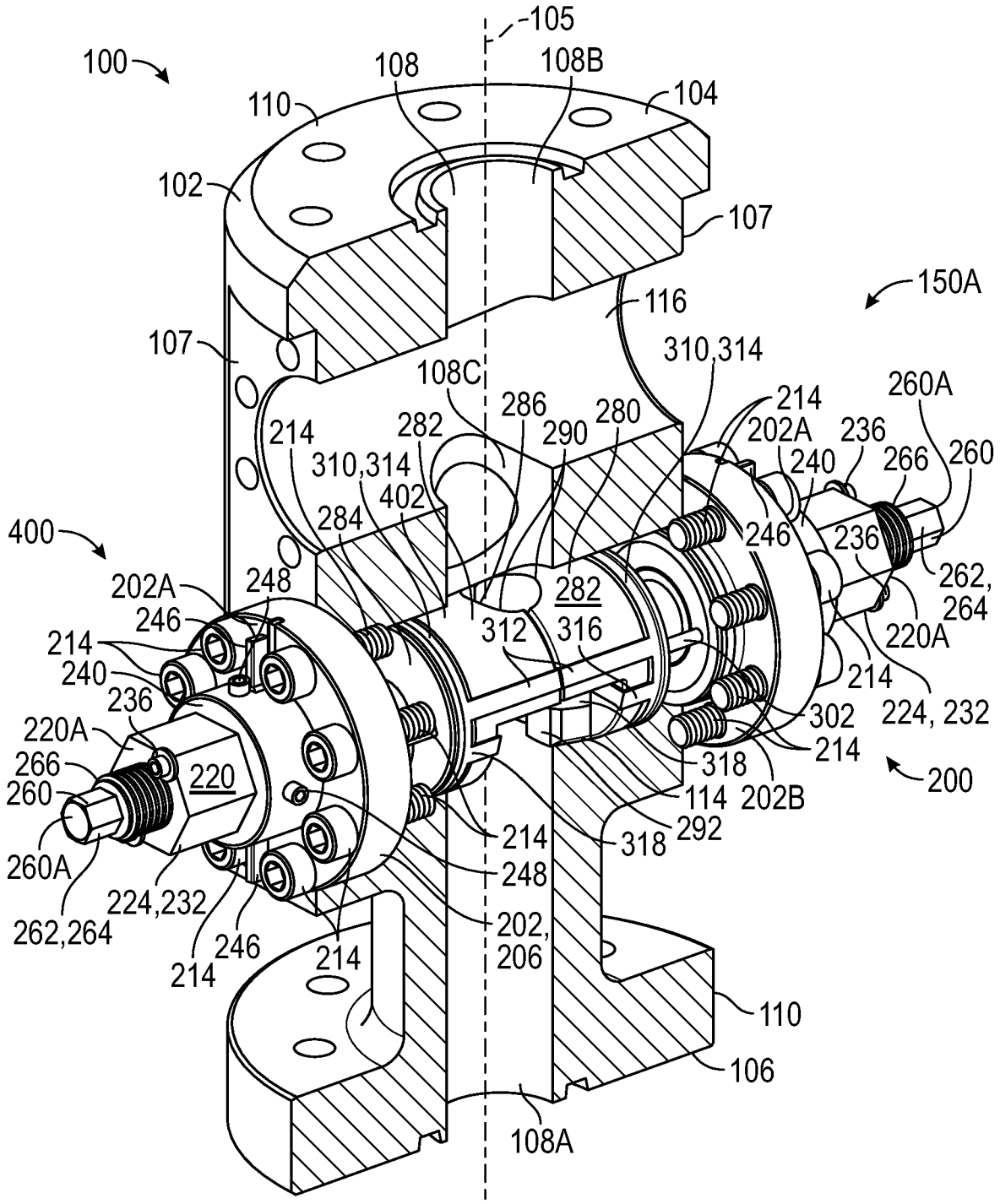
FIG. 12 is a perspective cross-sectional view of the ram BOP of FIG. 2 in a third position.

In the embodiment of FIGS. 2-15, variable ram BOP 100 may be actuated from the open rod position shown in FIG. 3 to the rod closed position shown in FIG. 12 via actuators 220 and stems 260 of ram assemblies 200, 400. Particularly, a torque may be applied to the hexagonal surface 264 of the stem 260 of each ram assembly 200, 400 via a tool (e.g., a wrench, etc.) to rotate the stems 260 relative to the housings 202 of ram assemblies 200, 400. Threadable engagement between the threaded portions 266 of the actuators 260 of ram assemblies 200, 400 and the threaded connectors 226 of actuators 220 forces the stems 260 radially inwards towards the central axis 105 of variable ram assembly 100. Engagement between the hexagonal surfaces 232 of actuators 220 and the hexagonal surfaces 244 of locking sleeves 240 of ram assemblies 200, 400 restrict relative rotation therebetween as stems 260 are rotated within actuators 220. Additionally, engagement between the locking tabs 246 of locking sleeves 240 and fasteners 214 restrict relative rotation between locking sleeves 240 and the housings 202 of ram assemblies 200, 400, housings 202 being rotationally locked to housing 102 via fasteners 214.

As stems 260 travel radially inwards through actuators 220, the inner end 260B of the stem 260 of first ram assembly 200 contacts the connector 300 of the first ram block assembly 280, forcing the first ram block assembly 280 to travel radially inwards in concert with the stem 260. Similarly, the inner end 260B of the stem 260 of second ram assembly 400 contacts the connector 300 of the second ram block assembly 402, forcing the second ram block assembly 402 to travel radially inwards in concert with the stem 260. First ram block assembly 280 is prevent from rotating as it travels radially inwards via the pins 302 extending between first ram block assembly 280 and the actuator 220 of first ram assembly 200. Similarly, second ram block assembly 402 is prevent from rotating as it travels radially inwards via the pins 302 extending between second ram block assembly 402 and the actuator 220 of second ram assembly 400. Ram block assemblies 280 and 402 of ram assemblies 200, 400 continue to travel radially inwards towards central axis 105 until the inner endface 286 of the first ram block assembly 280 engages the inner endface 286 of the second ram block assembly 402, disposing each of the ram block assemblies 280 and 402 in a second or radially inner position and the variable ram BOP 100 in the closed rod position.

As shown particularly in FIG. 12, in the closed rod position of variable ram BOP 100, first ram block assembly 280 is angularly or circumferentially aligned with second ram block assembly 402. In the closed rod position, the rod seal 312 of first ram block assembly 280 sealingly engages the outer surface of a tubular member (hidden in FIG. 12) extending through central passage 108 of housing 102, and the corresponding rod seal 312 of second ram block assembly 402. In this manner, fluid flow or communication is restricted across the interface formed between the tubular member and the inner endfaces 286 of ram block assemblies 280, 402. Additionally, in the closed rod position, rod seals 312 and circumferential seals 314 sealingly engage the inner surface of lower ram passages 116, preventing fluid flow or communication across the interface formed between ram passages 116 and ram block assemblies 280, 402. Thus, seal assemblies 310 of ram block assemblies 280, 402 restrict fluid flow or communication between a first or lower passage 108A and a second or upper passage 108B of central passage 108 when variable ram BOP 100 is in the closed rod position. Although hidden in FIG. 12, the upper set 150B of ram assemblies 200, 400 is configured similarly as the lower set 150A of ram assemblies 200, 400 when variable ram BOP 100 is in the closed rod position.

In the closed rod position of variable ram BOP 100, the first ram block assembly 280 of the lower set 150A of ram assemblies 200, 400 is positioned such that the axial ports 296 of first ram block assembly 280 are in fluid communication with the lower passage 108A. Thus, in the event of an uncontrolled pressurization of wellbore 5 and the lower end 21 of production tubing 20 requiring the closure of variable ram BOP 100 to isolate wellbore 5 from the surrounding environment, fluid pressure in the lower end 21 of production tubing 20 communicated to lower passage 108A of housing 102 will be communicated to axial ports 296 of the first ram block assembly 280 of lower set 150A via axial ports 296, thereby increasing the sealing integrity between the rod seals 312 of the lower set 150A of ram block assemblies 280, 402 and the outer surface of the tubular member (e.g., extension rod 25), as described above.

Particularly fluid pressure in axial ports 296 is communicated to the outer endface 284 of the ram block body 282 of first ram block assembly 280, which applies a pressure force against first ram block assembly 280 to thereby balance the fluid pressure acting against the endfaces 284, 286 of the ram block body 282 of first ram block assembly 280. Additionally, fluid pressure in lower passage 108A is in communication with the axial ports 296 of second ram block assembly 402, permitting fluid pressure communicated from the lower passage 108A to act against the outer endface 284 of the ram block body 282' of second ram block assembly 402 and thereby balance the fluid pressure acting against the endfaces 284, 286 of the ram block body 282' of second ram block assembly 402. Thus, the pressure balancing feature of the lower set 150A of ram assemblies 200, 400 permit variable ram BOP 100 to isolate wellbore 5 at higher pressures than variable ram BOP 100 could otherwise seal against without the pressure-assist functionality provided by the axial ports 296 of ram block bodies 282, 282'.

Still referring to FIGS. 2-15, variable ram BOP 100 may be periodically pressure tested to ensure the proper functioning of the lower set 150A and upper set 150B of ram assemblies 200, 400. Particularly, in an embodiment, a tubular member (e.g., extension rod 25) is extended through central passage 108 of housing 102 and both the lower set 150A and upper set 150B of ram assemblies 200, 400 are each actuated from a first or open position into a second or closed position such that the inner seal face 292A of each ram assembly 200A, 200B sealingly engages the outer surface of the tubular member. Particularly, when variable ram BOP 100 is in the open rod position shown in FIG. 3, the ram block assemblies 280, 402 of the lower set 150A of ram assemblies 200, 400 may each be actuated from a first or operating rod position, where the concave surface 290 of each ram block body 282, 282' is positioned adjacent an upper end of each lower ram passage 114, to a second or test rod position (shown in FIG. 13), where the concave surface 290 of each ram block body 282, 282' is positioned adjacent a lower end of each lower ram passage 114. Thus, in this embodiment, the test rod position of ram block assemblies 280, 402 of the lower set 150A of ram assemblies 200, 400 is circumferentially spaced approximately 180° from the operating rod position of ram block assemblies 280, 402.

In this embodiment, the ram block assemblies 280, 402 of the lower set 150A of ram assemblies 200, 400 may be actuated from the operating rod position to the test rod position by first removing the locking pins 248 of each ram block assembly 280, 402 and retracting the locking sleeve 240 of each ram block assembly 280, 402 is retracted from a first or locked position (shown in FIG. 3) to a second or unlocked position adjacent retainers 236. With the locking sleeve 240 of each ram block assembly 280, 402 of lower set 150A disposed in the unlocked position, a tool may be used to engage the hexagonal surface 232 of the actuator 220 of each ram assembly 200, 400 of lower set 150A to apply a torque thereto and rotate each actuator 220.

Figure 13:
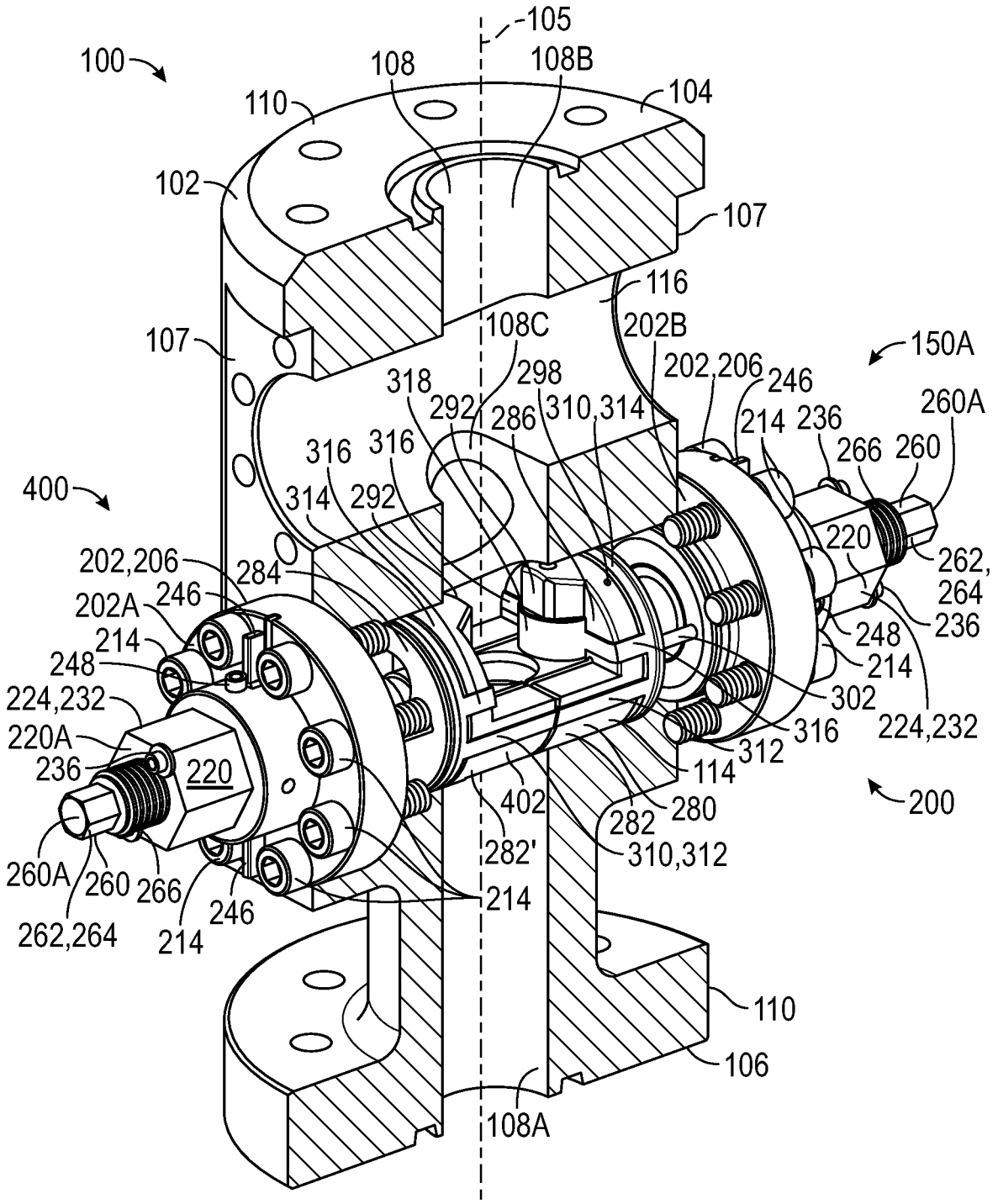
FIG. 13 is a perspective cross-sectional view of the ram BOP of FIG. 2 in a fourth position.

As described above, the actuator 220 of each ram assembly 280, 400 is rotationally locked with stem 260 and ram block assembly 280, 402, and thus, the rotation of the actuator 220 of each ram assembly 200, 400 of lower set 150A causes the stem 260 and ram block 280 of each ram assembly 200, 400 to rotate in concert therewith. In this embodiment, the ram block assemblies 280, 402 of the lower set 150A of ram assemblies 200, 400 are rotated approximately 180 degrees from the operating rod position to place each ram block assembly 280, 402 of the lower set 150A of ram assemblies 200, 400 in the test rod position (shown in FIG. 13); however, in other embodiments, the degree of rotation of ram block assemblies 280, 402 between the test rod and operating positions may vary. With the ram block assemblies 280, 402 of the lower set 150A of ram assemblies 200, 400 disposed in the test rod position, the ram assemblies 200, 400 of the lower and upper sets 150A, 150B of variable ram BOP 100 may be actuated to the radially inner position, as shown in FIG. 13, to seal against the outer surface of a tubular member extending through the central passage 108 of housing 102.

With the ram block assemblies 280, 402 of lower set 150A each disposed in the test rod position, the axial ports 296 of first ram block assembly 282 are now in fluid communication with a third or central chamber 108C of the central passage 108 which extends between the lower passage 108A and the upper passage 108B. Particularly, with variable ram BOP 100 disposed in the closed rod position (as shown in FIG. 13), the central chamber 108C is isolated from the lower and upper passages 108A, 108B via the sealing engagement formed between the rod seals 312 of the upper and lower sets 150A, 150B of ram assemblies 200, 400 and the outer surface of the tubular member extending through central passage 108. Although not shown in FIG. 13, the ram block assemblies 282, 402 of the upper set 150B of ram assemblies 200, 400 are positioned in the operating position, with the axial ports 296 of ram block body 282 in fluid communication with the central chamber 108C when variable ram BOP 100 is pressure tested in the closed rod position.

In this embodiment, a first or lower test port 118A is in fluid communication with lower passage 108A, a second or upper test port 118B is in fluid communication with the upper passage 108B, and a third or intermediate test port 118C is in fluid communication with central chamber 108C. In this configuration, hydraulic pressure may be applied to intermediate test port 118B from an external pressure source to thereby pressurize central chamber 108C of housing 102 and ascertain the sealing integrity of the lower and upper sets 150A, 150B of ram assemblies 200, 400. Fluid or test pressure is communicated from central chamber 108C to the axial ports 296 of the ram block body 282 of the first ram assembly 200 of both lower set 150A and upper set 150B, thereby equalizing pressure across each of the first ram block assemblies 280. Additionally, test pressure is communicated from central chamber 108C to the axial ports 296 of the ram block body 402 of the second ram assembly 400 of both lower set 150A and upper set 150B, thereby equalizing pressure across each of the second ram block assemblies 402. In this manner, the pressure equalization of each ram block assembly 280, 402 provided by axial ports 296 utilizes fluid pressure in central chamber 108C to assist or augment the sealing integrity between the rod seals 312 of ram block assemblies 280, 402 and the outer surface of the tubular member extending through housing 102, thereby permitting ram assemblies 200, 400 to sealingly close at higher fluid pressures within central passage 108.

In this embodiment, pressure may be increased in central chamber 108C of housing 102 until a desired test pressure in central chamber 108C has been achieved, at which point a valve (not shown) coupled between intermediate test port 118C and the pressure source may be closed to isolate central chamber 108C from the pressure source. With central chamber 108C closed in by the valve coupled to intermediate test port 118C, pressure within central chamber 108C may be monitored (e.g., via a pressure sensor attached to intermediate test port 118C) over a predetermined period of time or test period. An indication of sealing integrity between ram assemblies 200, 400 and the outer surface of the tubular member may be indicated by a stable pressure reading of central chamber 108C over the course of the test period.

However, a decline in pressure in central chamber 108C during the test period may indicate that a leak has formed between the tubular member and at least one of the ram assemblies 200, 400. In response to a decline in pressure in central chamber 108C, the valve coupled to upper test port 108C of housing 102 may be slowly opened to determine if fluid is being communicated between central chamber 108C and lower passage 108A, indicating a leak in one of the ram assemblies 200, 400 of lower set 150A. If no fluid communication between central chamber 108C and lower passage 108A is noted following the opening of the valve coupled to lower test port 118A, then the valve coupled to upper test port 118B may be opened to confirm that a leak has formed between the tubular member and at least one of the ram assemblies 200, 400 of the upper set 150B. In response to a positive indication that one of the ram assemblies 200, 400 is leaking, the suspected malfunctioning ram assemblies 200, 400 may be removed and replaced from the variable ram BOP 100.

Figure 14:
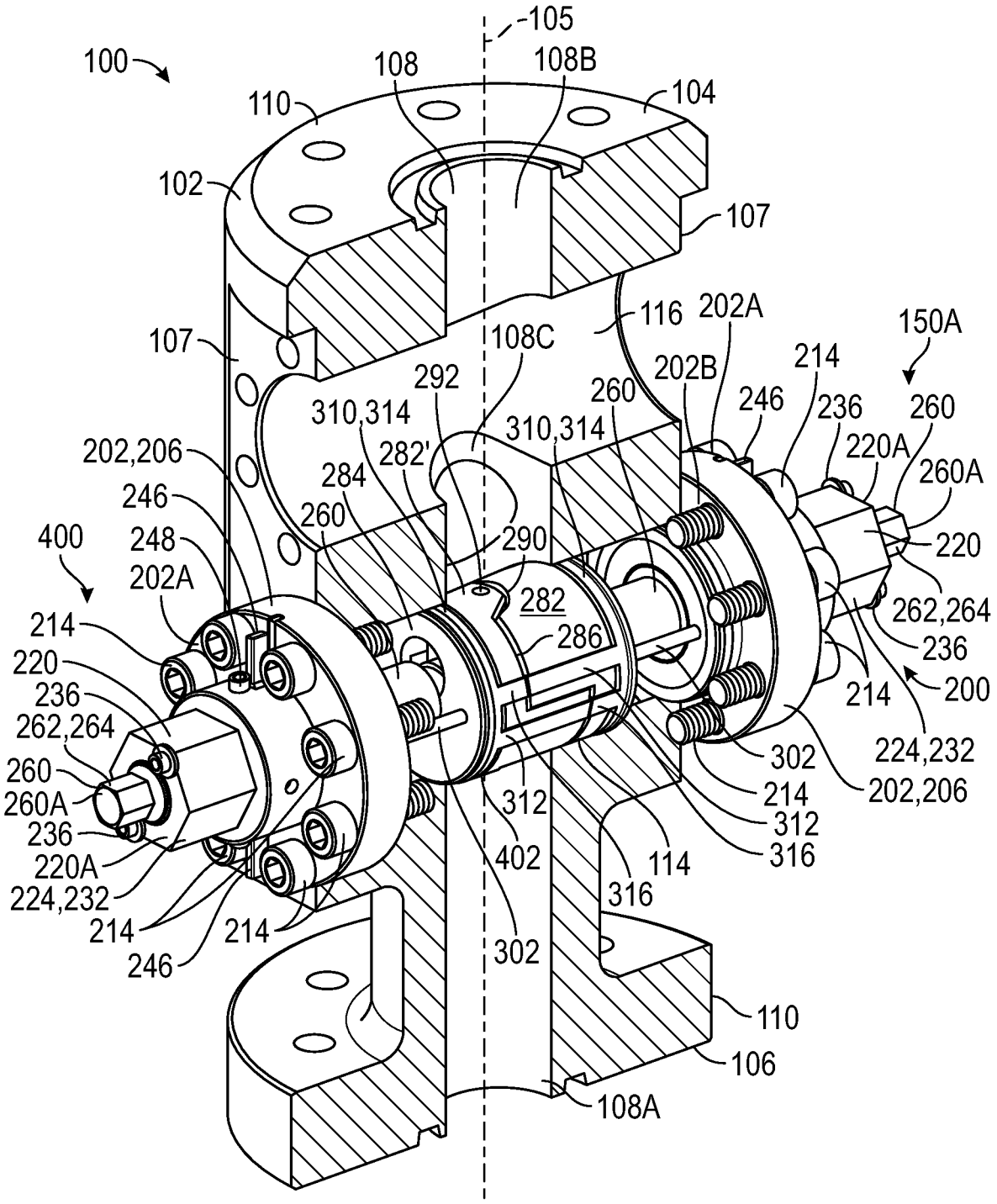
FIG. 14 is a perspective cross-sectional view of the ram BOP of FIG. 2 in a fifth position.
Figure 15:
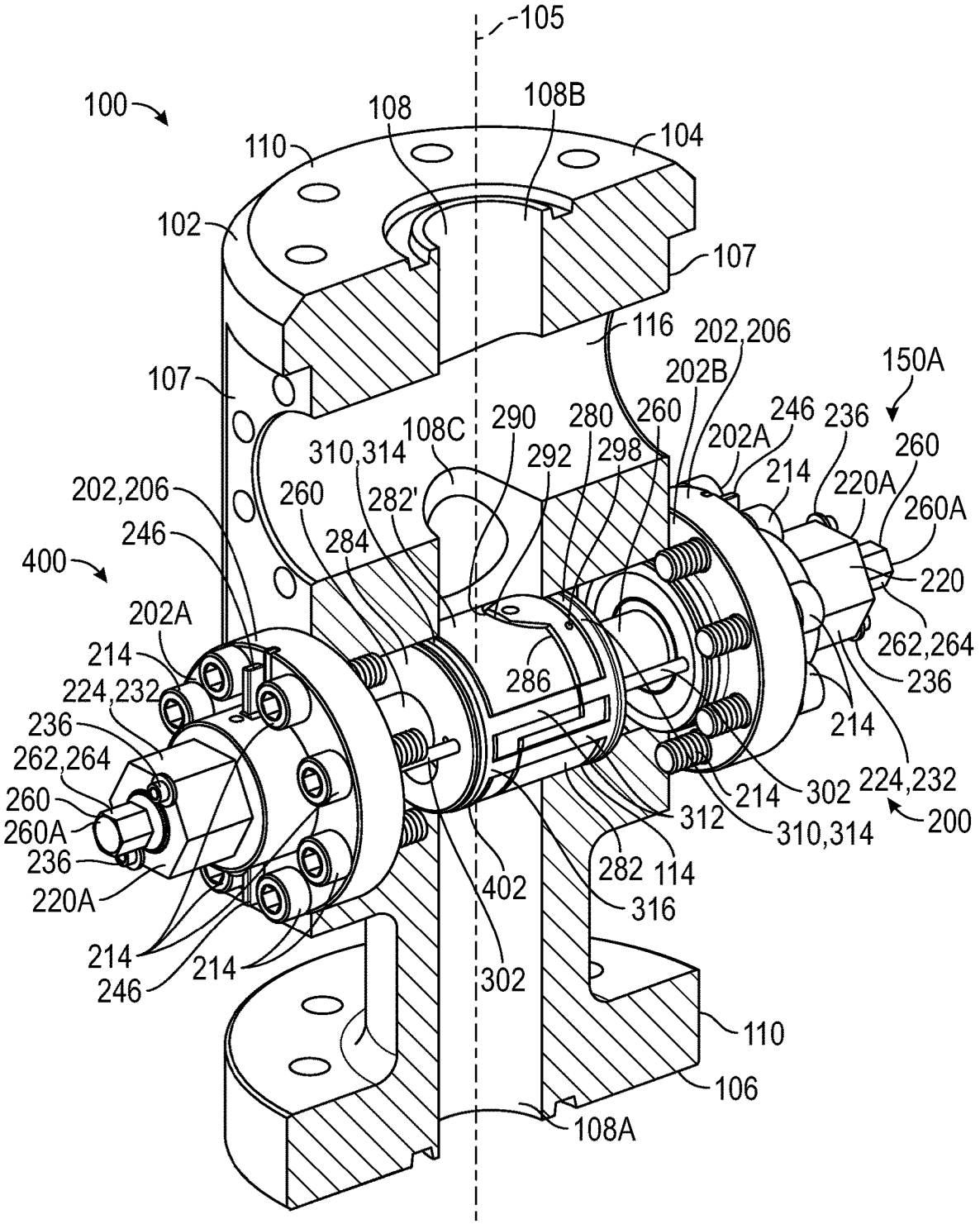
FIG. 15 is a perspective cross-sectional view of the ram BOP of FIG. 2 in a sixth position.

Referring particularly to FIGS. 14, 15, variable ram BOP 100 may be transformed or reconfigured from the rod configuration shown in FIGS. 3, 12, and 13 to the blind configuration shown in FIGS. 14, 15. Particularly, variable ram BOP 100 may be transformed or reconfigured into the blind configuration from the rod configuration, and transformed into the rod configuration from the blind configuration, without needing to remove or decouple ram assemblies 200, 400 from housing 102. Particularly, with variable ram BOP 100 disposed in the open rod position shown in FIG. 3, variable ram BOP 100 may be actuated or transformed into an open blind configuration by rotating the ram block assembly 402 of each second ram assembly 400 approximately 180 degrees from a first angular position to a second angular position such that the concave surface 290 of the ram block body 282' of each second ram assembly 400 is angularly or circumferentially aligned with the notch 292 of the ram block body 282 of each first ram assembly 200. The ram block assemblies 402 of variable ram BOP 100 may be rotated relative to ram block assemblies 280 by retracting the locking sleeve 240 of each second ram assembly 400 to the unlocked position and rotating ram block assemblies 402 via the actuator 220 of each second ram assembly 400.

With variable ram BOP 100 disposed in the open blind position, variable ram BOP 100 may be actuated into a second or closed blind position (shown in FIG. 14) to restrict fluid flow or communication through central passage 108 (where no tubular member extends through passage 108) by actuating each first ram block assembly 280 and each second ram block assembly 402 of variable ram BOP 100 from the radially outer position to the radially inner position via rotation of the stem 260 of each ram assembly 200, 400.

In the closed blind position of variable ram BOP 100 shown in FIG. 14, each first ram block assembly 280 is rotated or angularly offset approximately 180 degrees from each corresponding second ram block assembly 402 of variable ram BOP 100. In this configuration, the concave sealing surface 322 of the plug 318 of each first ram block assembly 280 sealingly engages the concave surface 290 of each corresponding second ram block assembly 402 of variable ram BOP 100. Additionally, in this configuration, the blind seal 316 of each first ram block assembly 280 sealingly engages the rod seal 312 of each corresponding second ram block assembly 402 of variable ram BOP 100. In this manner, fluid flow or communication is restricted across the interface formed between the inner endfaces 286 of ram block assemblies 280, 402.

The lower set 150A of ram assemblies 200, 400 also include operating blind and test blind positions when variable ram BOP 100 is in the blind configuration shown in FIGS. 14 and 15. Particularly, in the operating position of the lower set 150A of ram assemblies 200, 400 the radial ports 298 of the ram block body 282 of first ram assembly 280 are in fluid communication with the lower passage 108A. Thus, in the event of an uncontrolled pressurization of wellbore 5 and the lower end 21 of production tubing 20 requiring the closure of variable ram BOP 100 to isolate wellbore 5 from the surrounding environment, fluid pressure in the lower end 21 of production tubing 20 communicated to lower passage 108A of housing 102 will be communicated to axial ports 296 of the first ram block assembly 280 of lower set 150A via radial ports 298, thereby increasing the sealing integrity between ram block assemblies 280, 402.

Additionally, fluid pressure in the axial ports 296 of first ram block assembly 280 is in communication with the axial ports 296 of second ram block assembly 402, permitting the fluid pressure communicated from the lower passage 108A to act against the outer endface 284 of the ram block body 282' of second ram block assembly 402 and thereby balance the fluid pressure acting against the endfaces 284, 286 of the ram block body 282' of second ram block assembly 402. Thus, the pressure balancing feature of the lower set 150A of ram assemblies 200, 400 permit variable ram BOP 100 to isolate wellbore 5 at higher pressures than variable ram BOP 100 could otherwise seal against without the pressure-assist functionality provided by the axial ports 296 of ram block body 282', and the ports 296, 298 of ram block body 282.

Variable ram BOP 100 may be periodically pressure tested when in the blind configuration shown in FIGS. 14, 15 to ensure the proper functioning of the lower set 150A and upper set 150B of ram assemblies 200, 400. Particularly, when variable ram BOP 100 is in the closed blind position shown in FIG. 14, the ram block assemblies 280, 402 of the lower set 150A of ram assemblies 200, 400 may each be actuated from the operating blind position shown in FIG. 14, where the radial ports 298 of the ram block body 282 of first ram block assembly 280 are positioned proximal the lower end of ram passage 114, to the test blind position shown in FIG. 15, where the radial ports 298 of the ram block body 282 of first ram block assembly 280 are positioned proximal the upper end of ram passage 114 (second ram block assembly 402 rotating in concert with first ram block assembly 280). Thus, in this embodiment, the test blind position of ram block assemblies 280, 402 of the lower set 150A of ram assemblies 200, 400 is circumferentially spaced approximately 180° from the operating blind position of ram block assemblies 280, 402.

With the ram block assemblies 280, 402 of the lower set 150A of ram assemblies 200, 400 each disposed in the test blind position, the radial ports 298 of first ram block assembly 282 are now in fluid communication with a third or central chamber 108C of the central passage 108 which extends between the lower passage 108A and the upper passage 108B. Particularly, with variable ram BOP 100 disposed in the closed blind position (as shown in FIG. 15), the central chamber 108C is isolated from the lower and upper passages 108A, 108B via the sealing engagement formed between the blind seals 312 of the upper and lower sets 150A, 150B of ram assemblies 200, 400 and the outer surface of the tubular member extending through central passage 108. Although not shown in FIG. 15, the ram block assemblies 282, 402 of the upper set 150B of ram assemblies 200, 400 are positioned in the operating position, with the radial ports 298 of ram block body 282 in fluid communication with the central chamber 108C when variable ram BOP 100 is pressure tested in the closed blind position.

In this embodiment, hydraulic pressure may be applied to intermediate test port 118C from an external pressure source to thereby pressurize central chamber 108C of housing 102 and ascertain the sealing integrity of the lower and upper sets 150A, 150B of ram assemblies 200, 400. Fluid or test pressure is communicated from central chamber 108C to the radial ports 298 of the ram block body 282 of the first ram assembly 200 of both lower set 150A and upper set 150B, thereby equalizing pressure across each of the first ram block assemblies 280. Additionally, test pressure is communicated from central chamber 108C to the axial ports 296 of the ram block body 402 (via radial ports 298) of the second ram assembly 400 of both lower set 150A and upper set 150B, thereby equalizing pressure across each of the second ram block assemblies 402. In this manner, the pressure equalization of each ram block assembly 280, 402 provided by ports 296, 298 utilizes fluid pressure in central chamber 108C to assist or augment the sealing integrity between the rod seals 312 of ram block assemblies 280, 402 and the outer surface of the tubular member extending through housing 102, thereby permitting ram assemblies 200, 400 to sealingly close at higher fluid pressures within central passage 108.

In this embodiment, pressure may be increased in central chamber 108C of housing 102 until a desired test pressure in central chamber 108C has been achieved, at which point a valve coupled between intermediate test port 118C and the pressure source may be closed to isolate central chamber 108C from the pressure source. With central chamber 108C closed in by the valve coupled to intermediate test port 118C, pressure within central chamber 108C may be monitored (e.g., via a pressure sensor attached to intermediate test port 118C) over a predetermined period of time or test period. A decline in pressure in central chamber 108C during the test period may indicate that a leak has formed between the tubular member and at least one of the ram assemblies 200, 400. In response to a decline in pressure in central chamber 108C, the valve coupled to upper test port 108C of housing 102 may be slowly opened to determine if fluid is being communicated between central chamber 108C and lower passage 108A, indicating a leak in one of the ram assemblies 200, 400 of lower set 150A. If no fluid communication between central chamber 108C and lower passage 108A is noted following the opening of the valve coupled to lower test port 118A, then the valve coupled to upper test port 118B may be opened to confirm that a leak has formed between the tubular member and at least one of the ram assemblies 200, 400 of the upper set 150B. In response to a positive indication that one of the ram assemblies 200, 400 is leaking, the suspected malfunctioning ram assemblies 200, 400 may be removed and replaced from the variable ram BOP 100.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A blowout preventer, comprising:

a housing comprising a longitudinal passage and a pair of ram passages extending from the longitudinal passage;

a first ram assembly disposed in a first of the pair of ram passages and comprising first ram block assembly;

a second ram assembly disposed in a second of the pair of ram passages and comprising a second ram block assembly;

wherein the first ram block assembly is configured to comprise a first configuration in which the first ram block assembly sealingly engages an outer surface of a tubular member extending through the longitudinal passage of the housing when the blowout preventer is in a closed position, and a second configuration in which the first ram block assembly sealingly engages the second ram block assembly when the blowout preventer is in the closed position; and an actuator coupled to the first ram block assembly, wherein the actuator is configured to actuate the first ram block assembly between the first configuration and the second configuration, wherein the first ram block assembly is reconfigurable between the first configuration and the second configuration when the first ram block assembly is positioned in the first ram passage.

2. The blowout preventer of claim 1, wherein the second configuration of the first ram block assembly is circumferentially spaced from the first configuration of the first ram block assembly.

3. The blowout preventer of claim 1, further comprising a locking sleeve disposed about the actuator, wherein the locking sleeve comprises a locked position restricting relative rotation between the first ram block assembly and the housing and an unlocked position permitting relative rotation between the first ram block assembly and the housing.

4. The blowout preventer of claim 1, further comprising a stem extending through the actuator and coupled to the first ram block assembly, wherein the stem is configured to actuate the first ram block assembly between a radially inner position and a radially outer position relative a longitudinal axis of the housing.

5. The blowout preventer of claim 1, wherein:

the first ram block assembly comprises:

a ram block body comprising a first endface and a second endface opposite the first endface, wherein the second endface comprises a concave sealing surface; and a seal assembly coupled to the ram block body and comprising a rod seal and a plug defining a convex sealing surface, wherein the plug is positioned at the second endface of the ram block body;

the second ram block assembly comprises:

a ram block body comprising a first endface and a second endface opposite the first endface, wherein the second endface comprises a concave sealing surface; and a seal assembly coupled to the ram block body and comprising a rod seal and a plug defining a convex sealing surface, wherein the plug is positioned at the second endface of the ram block body.

6. The blowout preventer of claim 5, wherein:

the rod seal of the seal assembly of the first ram block assembly sealingly engages the rod seal of the seal assembly of the second ram block assembly when the first ram block assembly is in the first configuration and the blowout preventer is in the closed position; and the plug of the seal assembly of the first ram block assembly sealingly engages the concave sealing surface of the ram block body of the second ram block assembly when the first ram block assembly is in the second configuration and the blowout preventer is in the closed position.

7. The blowout preventer of claim 5, wherein the ram block body of the first ram block assembly comprises an axial port extending between the first endface and the second endface and a radial port extending between the axial port and an outer surface of the ram block body extending between the first endface and the second endface.

8. A blowout preventer, comprising:

a housing comprising a longitudinal passage and a pair of ram passages extending from the longitudinal passage; and a first ram assembly disposed in a first of the pair of ram passages and comprising a first ram block assembly, wherein the first ram block assembly comprises:

a ram block body comprising a first endface and a second endface opposite the first endface, wherein the second endface comprises a concave sealing surface; and a seal assembly coupled to the ram block body and comprising a plug defining a convex sealing surface, wherein the plug is positioned at the second endface of the ram block body.

9. The blowout preventer of claim 8, wherein the ram block body of the first ram block assembly comprises an axial port extending between the first endface and the second endface and a radial port extending between the axial port and an outer surface of the ram block body extending between the first endface and the second endface.

10. The blowout preventer of claim 9, further comprising:

a second ram assembly disposed in a second of the pair of ram passages and comprising a second ram block assembly, wherein the second ram block assembly comprises:

a ram block body comprising a first endface and a second endface opposite the first endface, wherein the second endface comprises a concave sealing surface and wherein the ram block body comprises an axial port extending between the first endface and the second endface; and a seal assembly coupled to the ram block body and comprising a plug defining a convex sealing surface, wherein the plug is positioned at the second endface of the ram block body.

11. The blowout preventer of claim 10, wherein the radial port of the ram block body of the first ram block assembly is in fluid communication with the axial port of the ram block body of the second ram block assembly when the blowout preventer is in a closed position.

12. The blowout preventer of claim 10, further comprising an actuator coupled to the first ram block assembly, wherein the actuator is configured to actuate the first ram block assembly between a first angular position and a second angular position circumferentially spaced from the first angular position.

13. The blowout preventer of claim 12, wherein:

the radial port of the ram block body of the first ram block assembly is in fluid communication with a first portion of the central passage extending from the first ram block assembly towards a first end of the housing when the first ram block assembly is in the first angular position; and the radial port of the ram block body of the first ram block assembly is in fluid communication with a first portion of the central passage extending from the first ram block assembly towards a first end of the housing when the first ram block assembly is in the first angular position.

14. The blowout preventer of claim 12, wherein the first ram block assembly comprises a first configuration configured to sealingly engage an outer surface of a tubular member extending through the longitudinal passage of the housing when the blowout preventer is in a closed position, and a second configuration configured to sealingly engage the second ram block assembly when the blowout preventer is in the closed position.

15. The blowout preventer of claim 14, further comprising an actuator coupled to the first ram block assembly, wherein the actuator is configured to actuate the first ram block assembly between the first configuration and the second configuration.

16. A method for operating a blowout preventer, comprising:

(a) actuating the blowout preventer into a first closed position in which a first ram block assembly of a first ram assembly and a second ram block assembly of a second ram assembly seal against a tubular member extending through a longitudinal passage of the blowout preventer;

(b) actuating the first ram block assembly from a first configuration to a second configuration; and (c) actuating the blowout preventer into a second closed position with the first ram block assembly sealing against the second ram block assembly.

17. The method of claim 16, wherein (b) comprises applying a torque to an actuator that is rotatably locked to the first ram block assembly to rotate the first ram block assembly from a first angular position to a second angular position.

18. The method of claim 17, further comprising:

(c) displacing a locking sleeve from a locked position to an unlocked position to permit relative rotation between the actuator and a housing of the first ram assembly.

19. The method of claim 16, wherein (c) comprises sealingly engaging a plug of a sealing assembly of the first ram block assembly with a concave sealing surface of a ram block body of the second ram block assembly.

* * * * *